US006244594B1

(12) United States Patent
Araseki et al.

(10) Patent No.: US 6,244,594 B1
(45) Date of Patent: Jun. 12, 2001

(54) APPARATUS FOR STORING SHEETS DRIVEN OUT OF AN IMAGE FORMING APPARATUS

(75) Inventors: Yoshiyuki Araseki, Kakuda; Masanori Takahashi, Iwanuma; Dai Itoh, Shibata-gun; Tatsuro Watanabe, Kakuda, all of (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/260,008

(22) Filed: Mar. 2, 1999

(30) Foreign Application Priority Data

Mar. 2, 1998 (JP) ..... 10-049173
Dec. 28, 1998 (JP) ..... 10-373774

(51) Int. Cl.[7] ..... B65H 39/16

(52) U.S. Cl. ..... 271/293; 271/258.01; 271/258.03; 271/296; 271/303

(58) Field of Search ..... 271/176, 292, 271/293, 294, 296, 303, 258.03, 258.01; 399/403

(56) References Cited

U.S. PATENT DOCUMENTS

| | | | |
|---|---|---|---|
| 3,765,670 | 10/1973 | Johnson . | |
| 3,788,640 | 1/1974 | Stemmle . | |
| 3,944,217 | 3/1976 | Greene et al. . | |
| 4,203,587 | 5/1980 | Kishi et al. . | |
| 4,352,490 | 10/1982 | Hatakeyame . | |
| 4,478,406 | 10/1984 | Dubois . | |
| 4,676,499 * | 6/1987 | Kimizuka et al. | 271/258.03 |
| 5,011,130 * | 4/1991 | Naito | 271/294 |
| 5,692,747 * | 12/1997 | Guerrero et al. | 271/291 |

FOREIGN PATENT DOCUMENTS

| | | | |
|---|---|---|---|
| 0259829 * | 3/1988 | (EP) | 271/293 |
| 2 066 778A * | 7/1981 | (GB) | 271/293 |
| 49-99038 | 9/1974 | (JP) . | |
| 56-7952 | 2/1981 | (JP) . | |
| 57-27752 | 6/1982 | (JP) . | |
| 60-10309 | 3/1985 | (JP) . | |
| 60-137769 | 7/1985 | (JP) . | |
| 0183464 * | 9/1985 | (JP) | 271/293 |
| 63-15223 | 4/1988 | (JP) . | |
| 2-23464 | 5/1990 | (JP) . | |
| 3-6104 | 1/1991 | (JP) . | |
| 7-41238 | 2/1995 | (JP) . | |
| 7-309520 | 11/1995 | (JP) . | |

* cited by examiner

*Primary Examiner*—H. Grant Skaggs
(74) *Attorney, Agent, or Firm*—Oblon, Spivak, McClelland, Maier & Neustadt, P.C.

(57) ABSTRACT

An apparatus for storing sheets carrying images thereon and sequentially driven out of an image forming apparatus in consecutive bins thereof is disclosed. The apparatus includes a deflector for deflecting a sheet toward the inlet of a preselected bin and a plurality of cylindrical cams cooperating to open and close the inlet of the bin. The deflector and cams are interlocked to each other to operate at a relatively high speed. The apparatus is capable of surely inserting a sheet into the inlet of the bin and highly reliable and durable.

22 Claims, 28 Drawing Sheets

APPARATUS FOR STORING SHEETS DRIVEN OUT OF AN IMAGE FORMING APPARATUS

BACKGROUND OF THE INVENTION

The present invention relates to an image forming apparatus and more particularly to an apparatus for storing sheets carrying images thereon and output from an image forming apparatus in a plurality of bins or bin trays thereof.

A sheet storing apparatus of the type described is extensively used with various kinds of image forming apparatuses including simple printers and copiers. The sheet storing apparatus including a plurality of bins is used in combination with a single tray for simply stacking sheets driven out of the image forming apparatus. Sheets sequentially discharged form the image forming apparatus are conveyed to the storing apparatus in a sort mode or to the tray in a mode other than the sort mode.

In the sheet storing apparatus, the bins are stacked one above the other. A sheet driven out of the image forming apparatus and conveyed by sheet feeding means is steered, or deflected, away from a transport path at an insertion position facing the inlet of a preselected bin. As a result, the sheet is received in the bin via the inlet. To cause the inlet of any desired bin and the insertion position to face each other, it is a common practice to move one of them relative to the other. With this scheme, it is possible to sequentially distribute sheets continuously conveyed by the sheet feeding device to the stack of bins.

For example, Japanese Patent Laid-Open Publication No. 49-99038 (corresponding to U.S. Pat. No. 3,788,640) teaches a sorting apparatus in which a stack of bins are moved up and down by cylindrical cams relative to a fixed insertion position where a sheet is steered away from a transport path. The bins are sequentially brought to the insertion position with their inlets sequentially broadened. A sheet is inserted into the broadened inlet of the bin located at the insertion position.

Japanese Patent Publication No. 3-6104 (corresponding to U.S. Pat. No. 4,478,406) discloses a sorting device in which an insertion position for sterring a sheet away from a transport position is movable. Cams facing the insertion position are rotated and moved upward or downward relative to a stack of bins, moving one bin facing the cams form one adjoining bin toward another adjoining bin. At this instant, the inlet of the one bin or that of one of the adjoining bins is broadened and caused to face the insertion position for thereby receiving a sheet. In this manner, sheets are sequentially inserted into the consecutive bins. This apparatus moving the cams up and down relative to the stack of bins reduces the moving range of the bins and therefore the overall height of the apparatus.

Japanese Patent Publication No. 56-7952 (corresponding to U.S. Pat. No. 3,765,670) proposes a sorting machine includes a stationary bin unit having a stack of bins, and a deflector assembly movable up and down relative to the bins on a vertical transport path. The deflector assembly deflects a sheet conveyed downward along a transport path at a sequentially varying insertion position, thereby inserting the sheet into one bin. Although this machine needs a relatively great distance between nearby bins and therefore renders the bin unit bulky, it does not need, e.g., cams for broadening the inlets of the bins.

The sorting apparatus taught in the above Laid-Open Publication No. 49-99038 has a problem that it includes too many sliding portions and movable portions to implement high-speed processing and sufficient reliability. Specifically, in the sorting apparatus, three cylindrical cams positioned vertically are rotated at the same time in order to move the stack of bins engaging therewith in the up-and-down direction, while the inlets of the bins are sequentially brought to the insertion position. The sorting machine taught in Publication No. 56-7952 has a drawback that the bin unit is bulky and occupies a broad space.

The sorting device disclosed in Publication No. 3-6104 successfully reduces the moving range of the stack of bins and therefore overall size of the device. However, the sorting device lacks in reliability as to the insertion of a sheet into the inlet of the bin based on the interlocked movement of the deflector and cams and as to high-speed operation.

Technologies relating to the present invention are also disclosed in, e.g. Japanese Patent Laid-Open Publication Nos. 7-309520 and 7-41238, Japanese Patent Publication Nos. 57-27752 (corresponding to U.S. Pat. No. 3,944,217), 60-10309 (U.S. Pat. No. 4,203,587) and 63-15223 (U.S. Pat. No. 4,352,490), Japanese Patent Publication No. 2-23464, and Japanese Patent Laid-Open Publication No. 60-137769.

SUMMARY OF THE INVENTION

It is therefore an object of the present invention to provide a reliable and durable sheet storing apparatus for an image forming apparatus including a deflector and cams which are capable of moving in unison at a relatively high speed and surely inserting a sheet into the inlet of a preselected bin.

An apparatus for storing sheets driven out of an image forming apparatus of the present invention includes a frame connectable to the image forming apparatus, a plurality of bins stacked on the frame, a sheet feeding device for feeding a sheet driven out of the image forming apparatus to a transport surface for deflection facing the bins, and a plurality of rails supported vertically by the frame and facing the edges of the bins. An elevatable frame is slidably supported by the rails. A plurality of cams are rotatably supported by the elevatable frame and each includes a cylindrical main portion. The cams cooperate, every time they make a rotation sufficient to feed one of two bins respectively contacting the upper end and lower end of the main portion to the other end, to broaden the inlet of the bin contacting the lower end. A cam drive device causes the cams to rotate. A sheet deflecting device is mounted on the elevatable frame for steering the sheet reached the transport surface toward the inlet of a preselected bin and inserting the sheet into the inlet.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
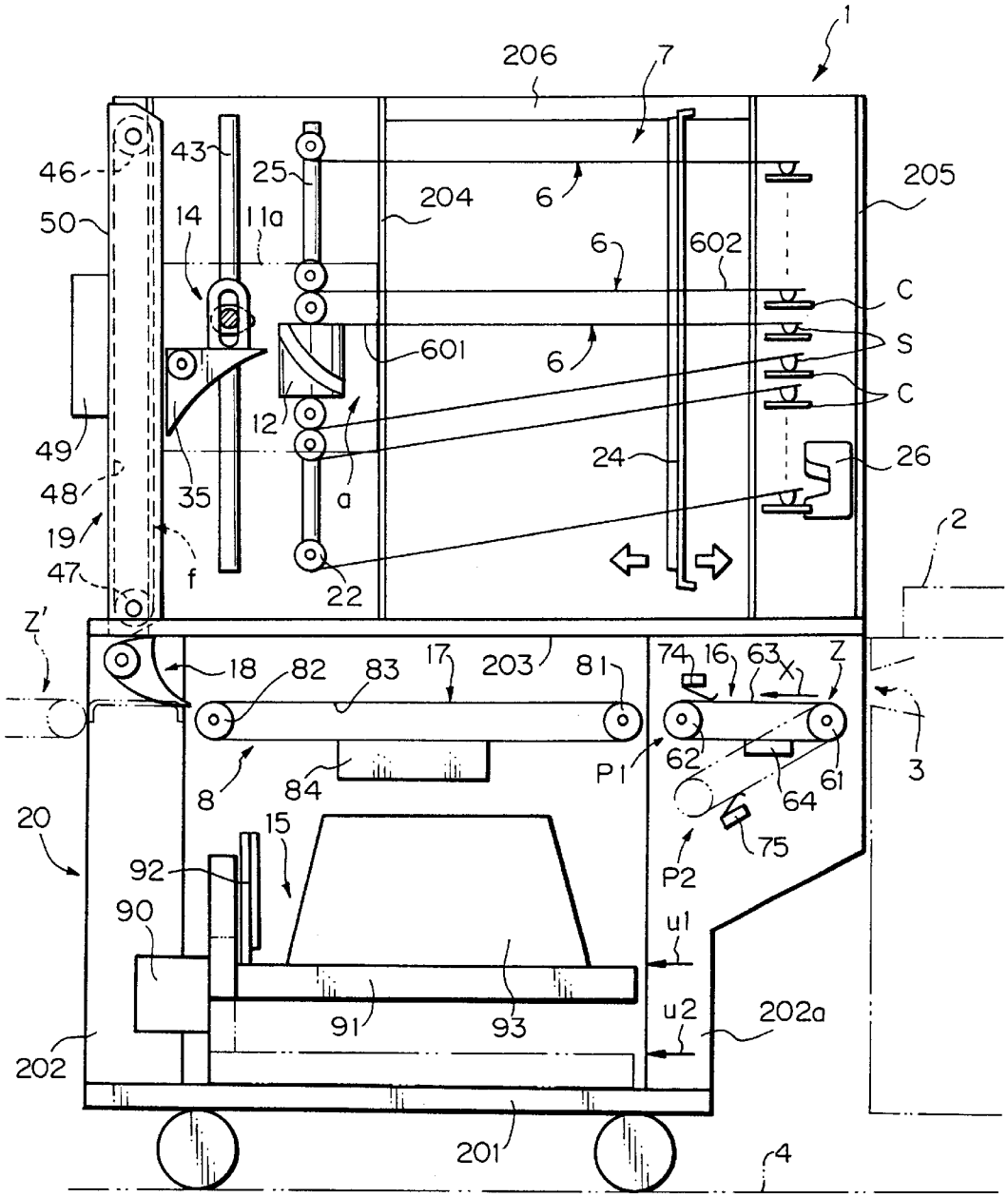
FIG. 1 is a sectional front view showing a sheet storing apparatus embodying the present invention.

Referring to FIG. 1, a sheet storing apparatus embodying the present invention is shown and generally designated by the reference numeral 1. As shown, the apparatus 1 is operatively connected to a stencil printer 2 which is a specific form of an image forming apparatus. The stencil printer 2 has a conventional construction including a drum not shown. After a perforated stencil or master has been wrapped around the drum, the drum is rotated while being fed with ink. A sheet is pressed against the drum via the master in order to print an image on the sheet. Then, the sheet or printing is driven out of the printer 2 via a discharge section. This kind of construction is taught in, e.g., Japanese Patent Laid-Open Publication No. 7-309520 by way of example.

The apparatus 1 is positioned on the same floor 4 as the printer 2 and has a portion Z aligning with an outlet 3 formed in the printer 2. The apparatus 1 is connected to the printer 2 at a part of a casing 20 included in the apparatus.

The casing 20 with a rectangular tower-like configuration has a plurality of bins (sometimes referred to as bin trays hereinafter) 6 stacked thereinside. Sheet feeding means 8 conveys sheets sequentially driven out of the printer 2 to a transport surface f which faces the bins 6 at a deflection side. A plurality of rails 9*m* and 9*n* (see FIG. 2) are supported by the casing 20 and face the edges of the bins 6. An elevatable frame 11 (see FIG. 10) is slidably supported by the rails 9*m* and 9*n*. Two cams 12 each having a cylindrical main portion 121 are respectively rotatably supported by a front half 11*a* and a rear half 11*b* (see FIG. 3) constituting the elevatable frame 11. Cam drive means 13 is mounted on the frame 11 for causing the two cams 12 to rotate. Sheet deflecting means 14 is also mounted on the frame 11 for steering the sheet reached the transport surface f to the inlet a of preselected one of the bins 6. A tray 15 is positioned in the lower portion of the casing 20 for stacking sheets directed thereto via the portion Z.

The sheet feeding means 8 is made up of a first switching section 16, a horizontal transport section 17, a second switching section 18, and a vertical transport section 19. The first switching section 16 has an upstream end in the direction of sheet transport adjoining the portion Z and a downstream end which is angularly movable. The horizontal transport section 17 is operatively connected to the first switching section 16 when the section 16 is located at a sorting position p1 (solid line in FIG. 1) which will be described later. The second switching section 18 adjoins the downstream end of the horizontal transport section 17. The vertical transport section 19 defines the transport surface f.

The casing 20 is made up of a bottom 201, a plurality of lower frame portions 202 extending vertically upward from the bottom 201, and a plurality of middle tie portions 203 connecting the tops of the lower frame portions 202 in the horizontal direction. In addition, a plurality of upper frame portions 204 and 205 extend vertically upward from the tie portions 203 and have their tops connected together by top tie portions 206 in the horizontal direction.

The lower frame portions 202 include a front and a rear lower frame portion 202*a* located at the right-hand side as seen in FIG. 1. The ends of the two lower frame portions 202*a* are connected to the casing, not shown, of the printer 2 by brackets not shown. A bin unit 7 including the bins 6 and the vertical transport section 19 facing the bins 6 are arranged in the upper portion of the casing 20.

Figure 4:
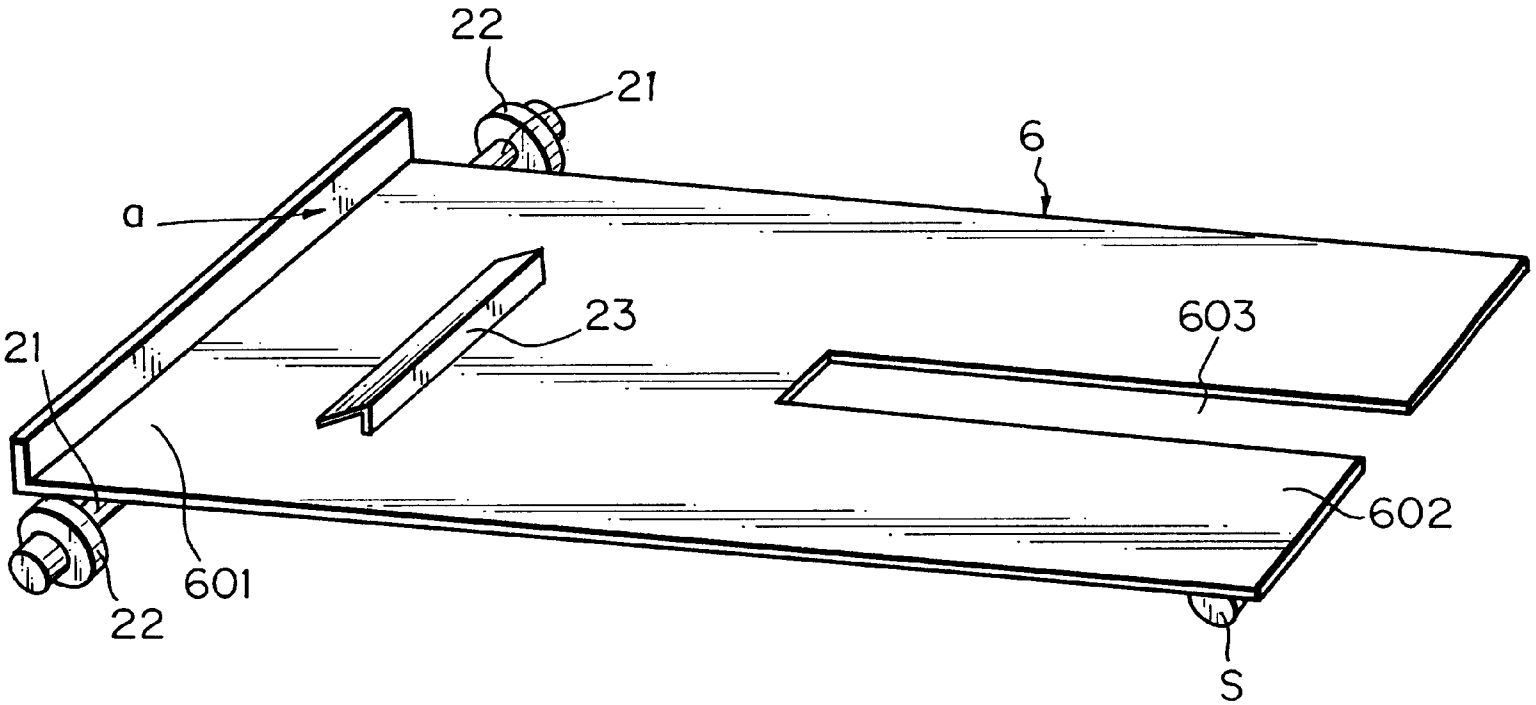
FIG. 4 is a perspective view showing one of bins included in the illustrative embodiment.

The bin unit 7 is interposed between the right and left upper frame portions 205 and 204, as viewed in FIG. 1, at its front side and rear side. As shown in FIG. 4, each bin 6 is implemented by flat sheet steel although it may be formed of resin. The space between the right and left frame portions 204 and 205 surrounding the bins 6 are open, so that the operator can easily take out the sheets from desired bins 6 at the front of the apparatus 1.

Specifically, as shown in FIGS. 1 and 4, each bin 6 has a length between an inlet end 601, which is the inlet a mentioned earlier, and the other end 602 selected to be greater than the maximum sheet size available with the bin 6. The two ends 601 and 602 face each other at the left side and right side, as viewed in FIG. 4. The inlet end 601 of the bin 6 is supported by the left upper frame portions 204 via the elevatable frame 11 while the other end 602 is supported by the right upper frame portions 205 via locking pieces c. Pins 21 extend out from opposite sides of the inlet end 601, and each supports a trunnion 22 resembling a stepped roller. The pins 21 are respectively received in slots 25 formed in the adjoining left upper frame portions 204 and elongate in the up-and-down direction. In this condition, the pins 21 are prevented form moving in the horizontal direction. The bins 6 and therefore their pins 21 and trunnions 22 are supported by the left upper frame portions 204 one above the other. The inlet ends 601 of the bins 6 adjoining each other in the up-and-down direction are spaced by an extremely small distance from each other.

The right end 602 of each bin 6 is movably supported by the tops of the locking pieces c respectively protruding from the front and rear right frame portions 205. The distance between the bins 6 adjoining each other in the up-and-down direction is selected such that it is not so narrow as to block the entry of the sheet and does not compress the sheet to a degree influencing an unfixed image carried on the sheet. Because each bin 6 has the previously mentioned length greater than the maximum sheet size, a relatively small distance should only be formed between the right ends 602 of nearby bins 6 by use of the locking pieces c and spacers s. That is, it is not necessary to render the above distance variable and increase it at the time of entry of the sheet.

A stapler 26 is supported by the right frame portions 205 adjoining the right ends 602 of the bins 6. The stapler 26 is movable up and down via a guide mechanism, not shown, for stapling the sheets stacked on the bins 6. A gripper, not shown, is associated with the stapler 26 for conveying a stack of sheets toward the stapler 26. In this sense, the positional accuracy between the gripper and stapler 26 and the stack of sheets of each bin 6 is an essential characteristic value when it comes to stapling. Therefore, the positional accuracy of each bin 6 in the up-and-down direction is important. In the illustrative embodiment, each bin 6 is supported by the respective locking pieces c playing the role of support members while the locking pieces c are implemented as brackets of the type scattering the strength of the support members. This successfully guarantees the above positional accuracy of each bin 6. Consequently, only the weight of sheets stacked on the bin 6 acts on the locking pieces c as a load, enhancing durability and reducing noise.

Figure 18B:
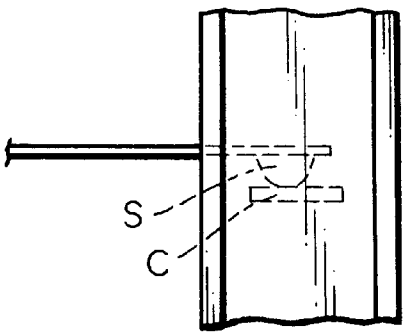
FIGS. 18A and 18B are respectively a plan view and a front view showing a specific structure for supporting the right end of a bin.
Figure 18A:
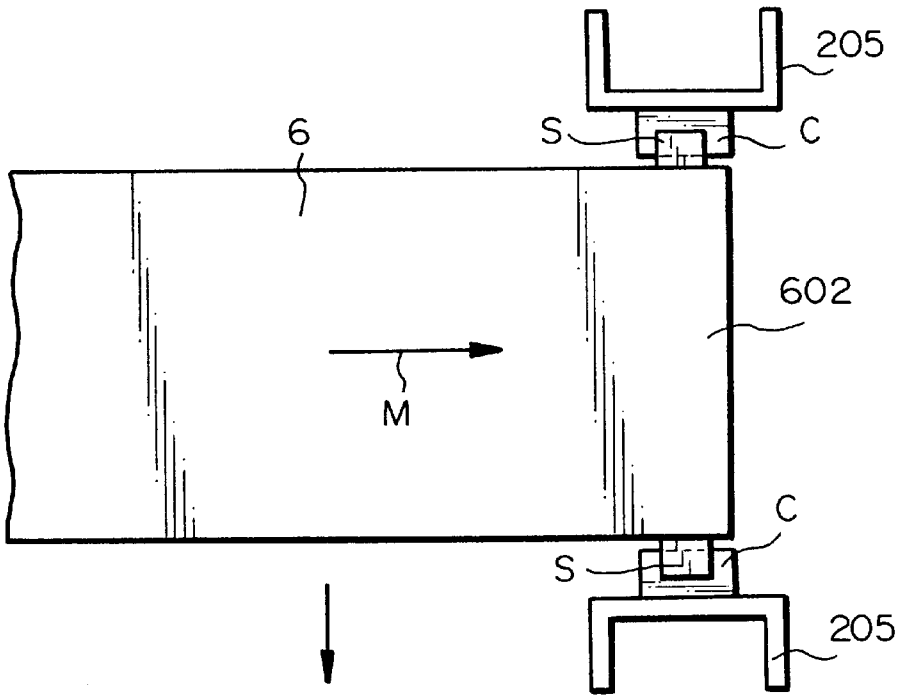

As shown in FIGS. 18A and 18B, the left end 602 of each bin 6 may be supported by the right frame portions 205 at both sides thereof. However, in the illustrative embodiment, the operator is expected to take out a sheet stack toward the operator, i.e., in parallel to the operation panel of the printer 2 via the space between the front right frame portion 205 and the front left frame portions 204. Therefore, the structure shown in FIGS. 18A and 18B might cause the right frame portion 205 to interfere with the leading edge of the sheet stack in the direction of sheet entry (arrow M).

Figure 19A:
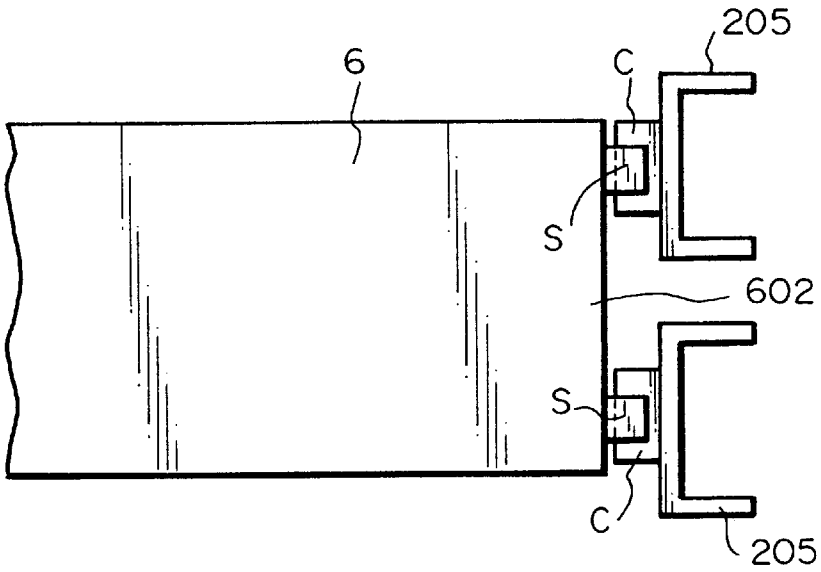
FIGS. 19A and 19B are respectively a plan view and a front view showing another specific structure for supporting the right end of a bin.
Figure 19B:
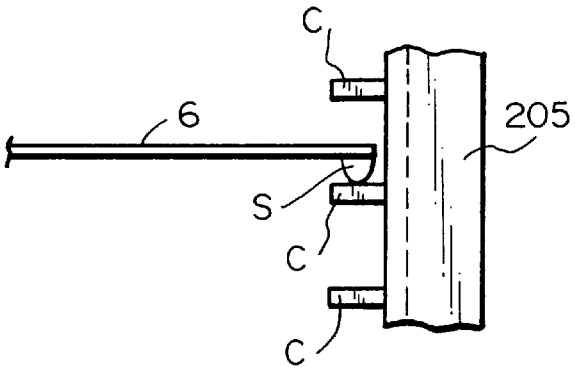

In light of the above, as shown in FIGS. 19A and 19B, the spacers s protrude from the right end 602 of each bin 6 in the direction of sheet entry, and the right frame portions 205 are arranged side by side so as to support the spacers s. In this structure, the right frame portion 205 do not obstruct the sheet stack and form a space great enough for the operator to easily take out the sheet stack.

Referring again to FIG. 4, a slant well or ridge 23 is positioned on each bin 6 in the vicinity of the inlet end 601. As shown in FIG. 4, the sheet introduced into the bin 6 hits against an end fence 24 disposed in the bin unit 7 and then drops onto the bin 6. At this instant, because the bin 6 is inclined leftward downward, as viewed in FIG. 1, the slant wall 24 is provided with a height slightly greater than the maximum height of sheets to be stacked on the bin 6. In addition, the slant wall 23 prevents the leading edge of a sheet entering the bin 6 from abutting against the edge of a sheet stack existing on the bin 6 and allows it to be surely laid on the top of the sheet stack. The slant wall 23 allows even a slightly curved sheet to jump onto the top of the existing sheet stack. A notch 603 is formed in the right end 602 of the bin 6 toward the inlet end a. The end fence 24 is received in the notch 603 and movable over a preselected distance in the right-and-left direction, as viewed in FIG. 1, by being driven by a feed mechanism not shown. The end fence 24 is therefore capable of stopping a sheet entering the bin 6 via the inlet end a at a preselected position matching with the size of the sheet. At the same time, the end fence 24 prevents the sheet from being dislocated when stacked.

Figure 2:
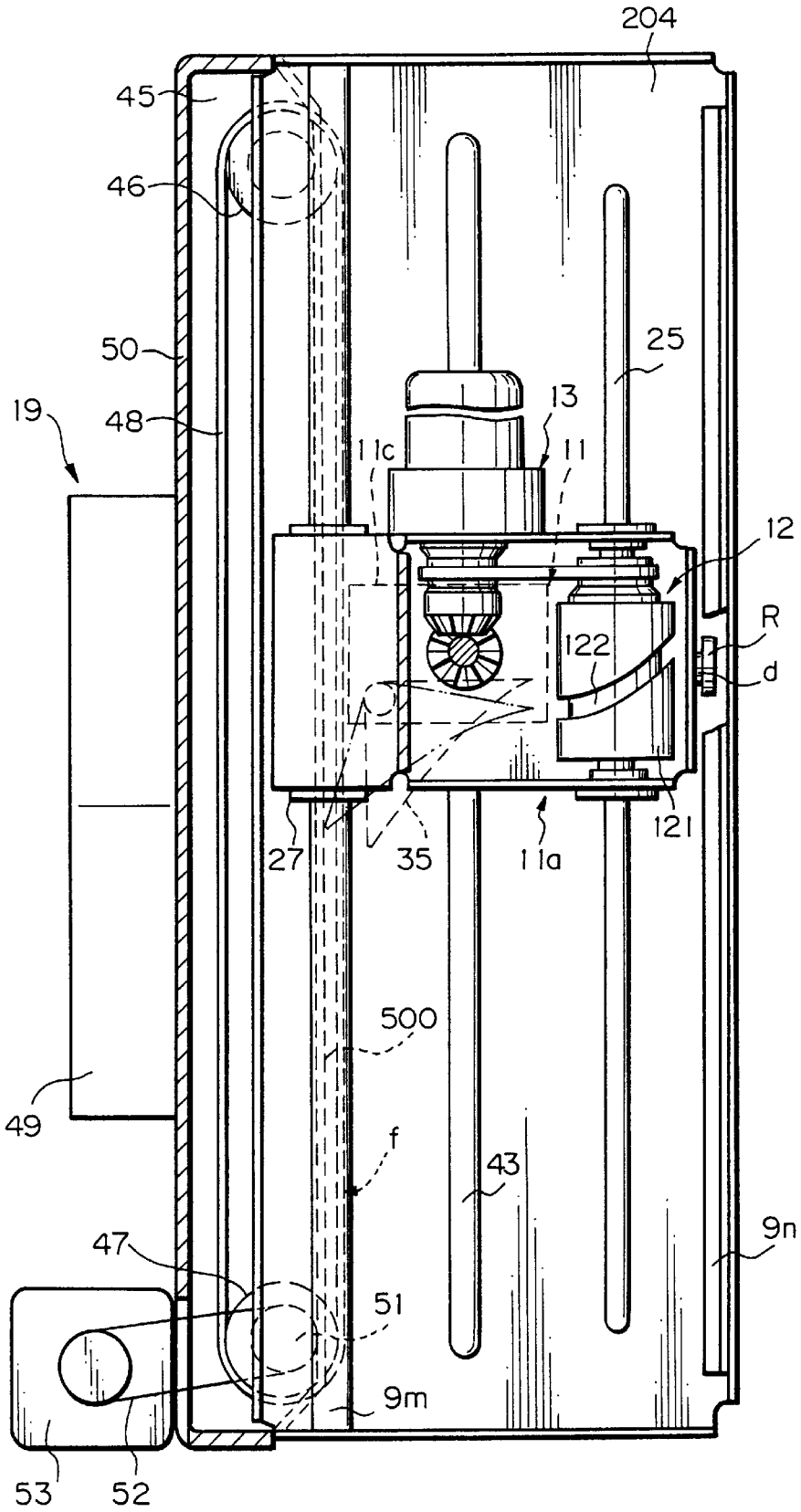
FIG. 2 is a partly taken away front view of a left vertical frame portion and an elevatable frame included in the illustrative embodiment.
Figure 6:
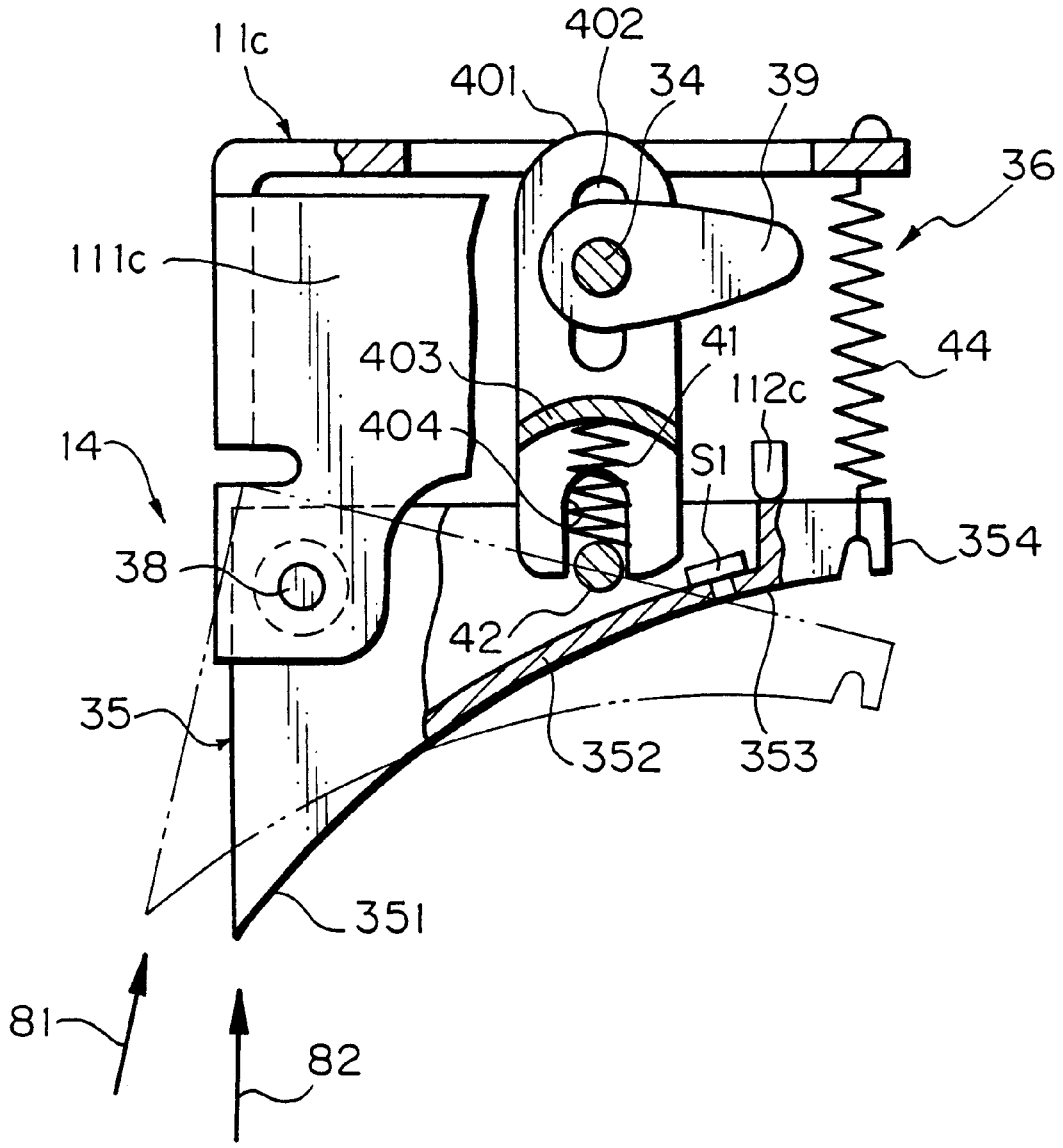
FIG. 6 is a partly taken away section showing the deflector.
Figure 7:
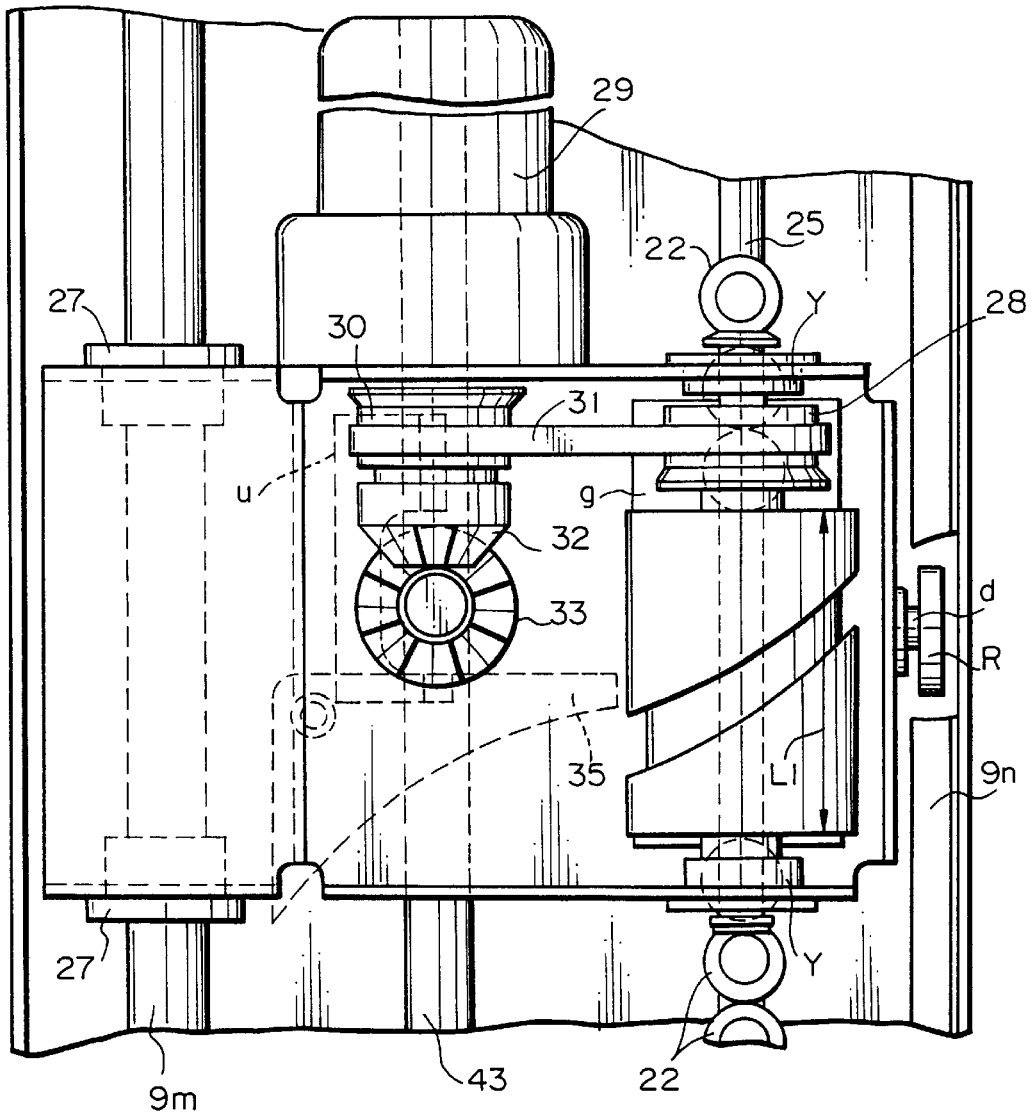
FIG. 7 is a fragmentary front view showing the left frame portion and elevatable frame.
Figure 10:
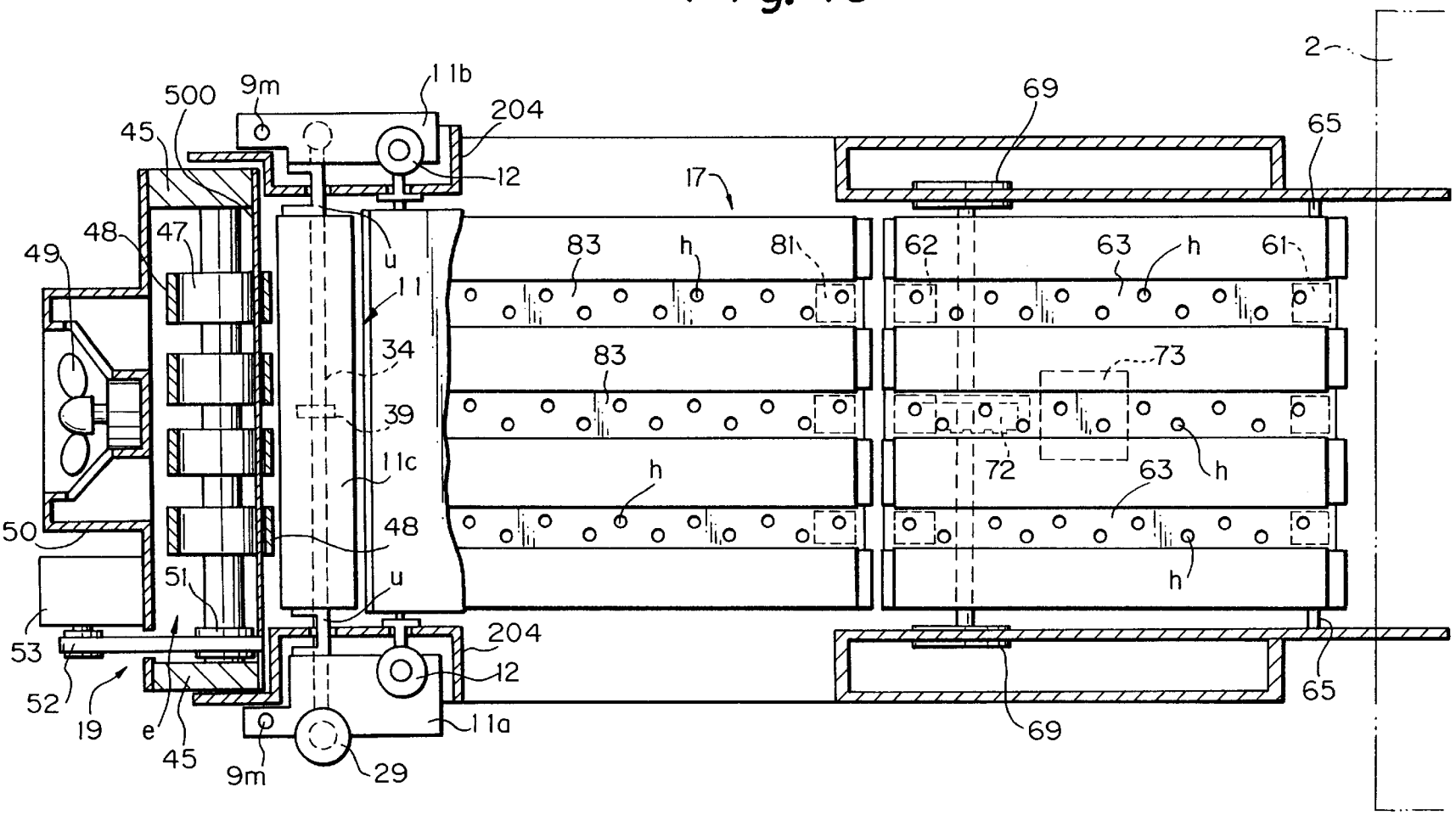
FIG. 10 is a partly taken away plan view showing a horizontal transport section and a vertical transport section included in the illustrative embodiment.

The left frame portions 204 are respectively positioned at the front and the rear in the vicinity of the edges of the inlet end 601 of the bin 6. As shown in FIG. 2, a first rail 9*m* and a second rail 9*n* are mounted on the front left frame portion 204 while another first rail 9*m* and another second rail 9*n* are mounted on the rear left frame portion 204. The elevatable frame 11 has its front half 11*a* and rear half 11*b* slidably supported by the front rails 9*m* and 9*n* and rear rails 9*m* and 9*n*, respectively. As shown in FIGS. 7 and 10, the front half 11*a* and rear half 11*b* are connected together by a bracket 11*c* (see FIG. 6 also) and L-shaped brackets u mounted on both ends of the bracket 11*c*. The L-shaped brackets u are respectively movably received in vertical elongate slots 43 (see FIG. 7) formed in the front and rear left frame portions 204.

As shown in FIG. 2, the first rail 9*m* supported by the front left frame portion 204 is implemented as a bar and has its top and bottom affixed to the top and bottom horizontal flanges of the frame portion 204. The second rail 9*n* has its base end welded to the bent vertical flange of the frame portion 204. The front half 11*a* of the frame 11 supported by the front rails 9*m* and 9*n* is implemented as a substantially rectangular bracket and has a front support portion 27 at its left end. A guide roller R is rotatably mounted on the right end of the front half 11*a* via a horizontal pin d. The front support portion 27 is a hollow cylinder formed of resin and slidably engaged with the rail 9*m*. The guide roller R is so configured as to roll on the rail 9*n* and the wall of the left frame portion 204 without any play. The rear half 11*b* of the frame 11 is symmetrical to the front half 11*a* in the right-and-left direction. The front half 11*a* and rear half 11*b* connected together by the bracket 11*c* are movable up and down without any play while being guided by the front rails 9*m* and 9*n* and rear rails 9*m* and 9*n*.

Figure 9:
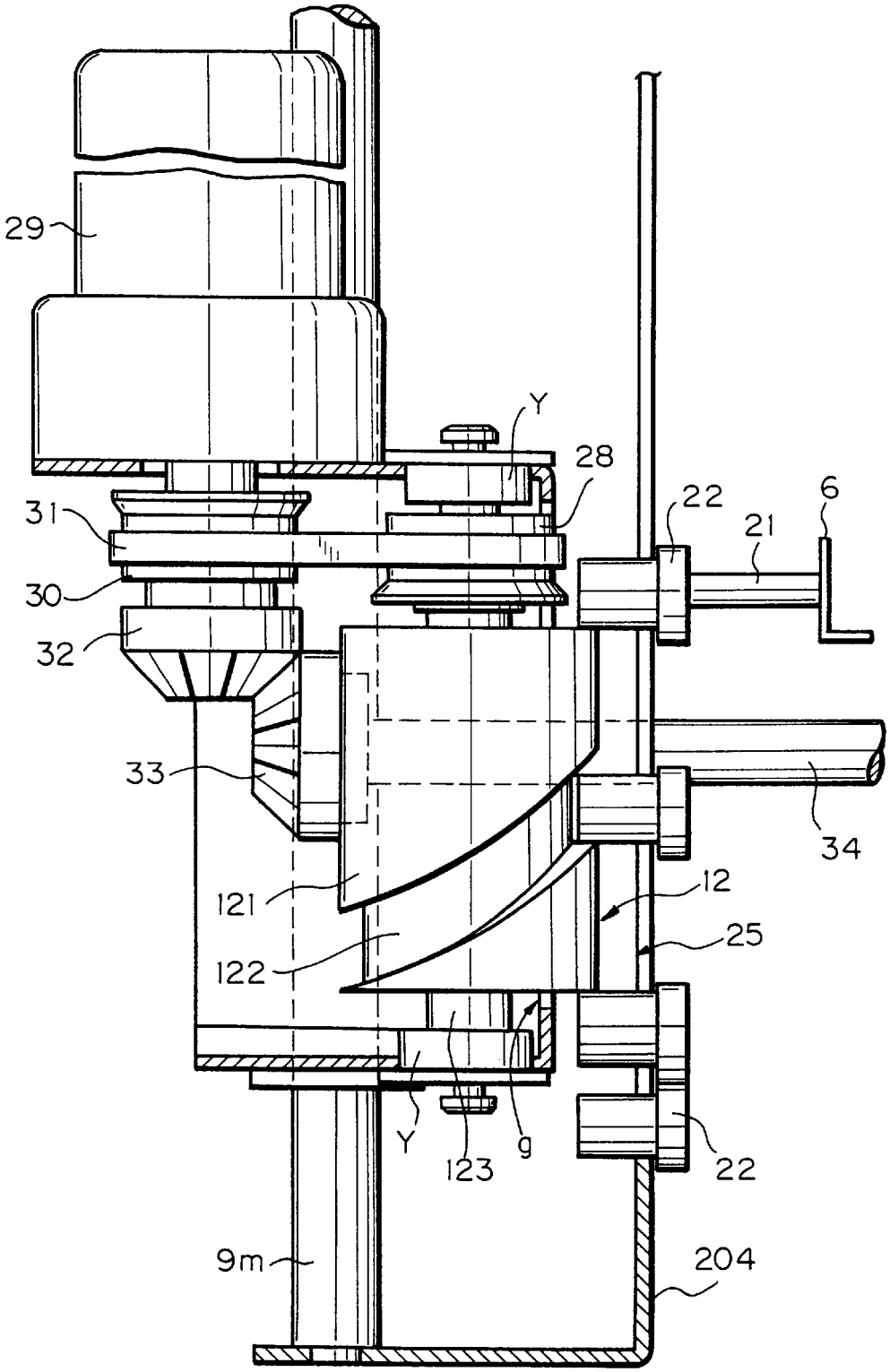
FIG. 9 is a fragmentary side elevation showing the left frame portion and elevatable frame.

As shown in FIG. 2, the cams 12 and cam drive means 13 for causing the cams 12 to rotate are mounted on the front half 11*a* of the frame 11. As shown in FIGS. 7 and 9, each cam 12 includes a vertical cam shaft 123 rotatably supported by the upper and lower flanges of the front half 11*a* via an upper and a lower bearing portion Y. The cylindrical main portion 121 mentioned earlier is rotatably supported via the cam shaft 123. A spiral cam groove 122 is formed in the circumferential surface of the main portion 121. An opening g (see FIGS. 7 and 9) facing the front left frame 204 is formed in the portion of the front half 11*a* facing the main portion 121. The opening g is formed such that the cam 12 with which the trunnion 22 of the bin 6 is engageable and a cam pulley 28 are movably received in the opening g and partly protrude toward the guide slot 25 therethrough.

The cam groove 122 of the cam 12 allows the smaller diameter portion of the trunnion 22 to slide into and out of the groove 122. The trunnion 22 is configured such that its smaller diameter portion is movably received in the guide slot 25 of the front left frame portion 204 while its larger diameter portion is stopped by opposite edges of the slot 25. The trunnion 22 is therefore allowed to move only in the up-and-down direction by the guide slot 25. Therefore, when the cam 12 is caused to rotate, it moves the trunnion 22 contacting either one of its upper end and lower end toward the other end along the sum groove 122 in accordance with the direction of rotation. In the illustrative embodiment, the cam 12 is configured to feed one trunnion 22 by a distance L1 between the upper end and the lower end of the cam 12 by one rotation thereof although such an amount of feed is only illustrative. The other cam 12 is mounted on the rear half 11*b* symmetrically to the cam 12 of the front half 11*a*.

Figure 3:
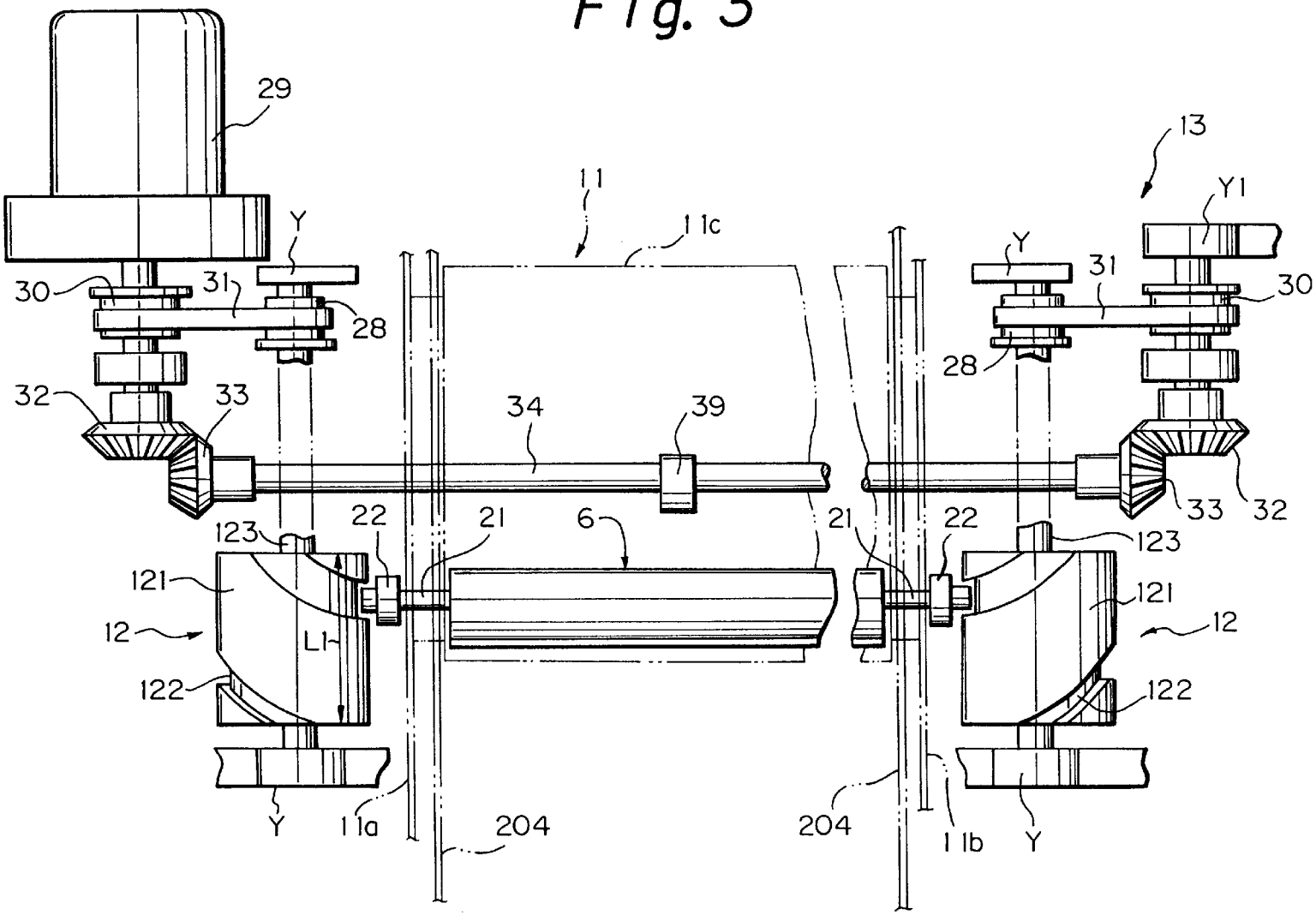
FIG. 3 is a side elevation showing cam drive means included in the illustrative embodiment.

The cam drive means 13 extends over the entire elevatable frame 11. As shown in FIGS. 3, 7 and 9, the part of the cam drive means 13 mounted on the front half 11*a* includes the cam pulley 28 affixed to the top of the cam 12 via the cam shaft 123. A drive motor 29 is mounted on the front half 11*a* and drivably connected to a drive pulley 30. An endless belt 31 is passed over the drive pulley 30 and cam pulley 28. A drive gear 32 is formed on the bottom of the drive pulley 30 and implemented as a bevel gear. A driven gear 33 is held in mesh with the drive gear 32 and also implemented as a bevel gear. The gear 33 is mounted on a shaft 34 rotatably supported by the major portion of the front half 11*a*. The other end of the shaft 34 is rotatably supported by the major portion of the rear half 11*b*. The other part of the cam drive means 13 mounted on the rear half 11*b* is identical with and symmetrical to the above part except that it lacks the drive motor 29. Labeled Y1 is a bearing portion rotatably connecting the drive gear 323 to the rear half 112 and replacing the drive motor 29.

When the drive motor 29 is energized, it rotates the shaft 34 via the bevel gear training. The rotation of the shaft 34 is transferred to the drive pulleys 30 of the front half 11*a* and rear half 11*b* and further to the cams 12 via the belts 31 and cam pulleys 28. At this instant, the shaft 34 allows the cams 12 of the front half 11*a* and rear half 11*b* to rotate surely and stably in synchronism with each other, as shown in FIGS. 3 and 10. The cams 12 therefore respectively feed the front and rear trunnions 22 of one bin 6 at the same time. As a result, the inlet and 601 of the bin 6 is raised or lowered by the distance L1 by one rotation of the cams 12, forming the inlet a close to the distance L1 between it and the adjoining bin 6.

Figure 5:
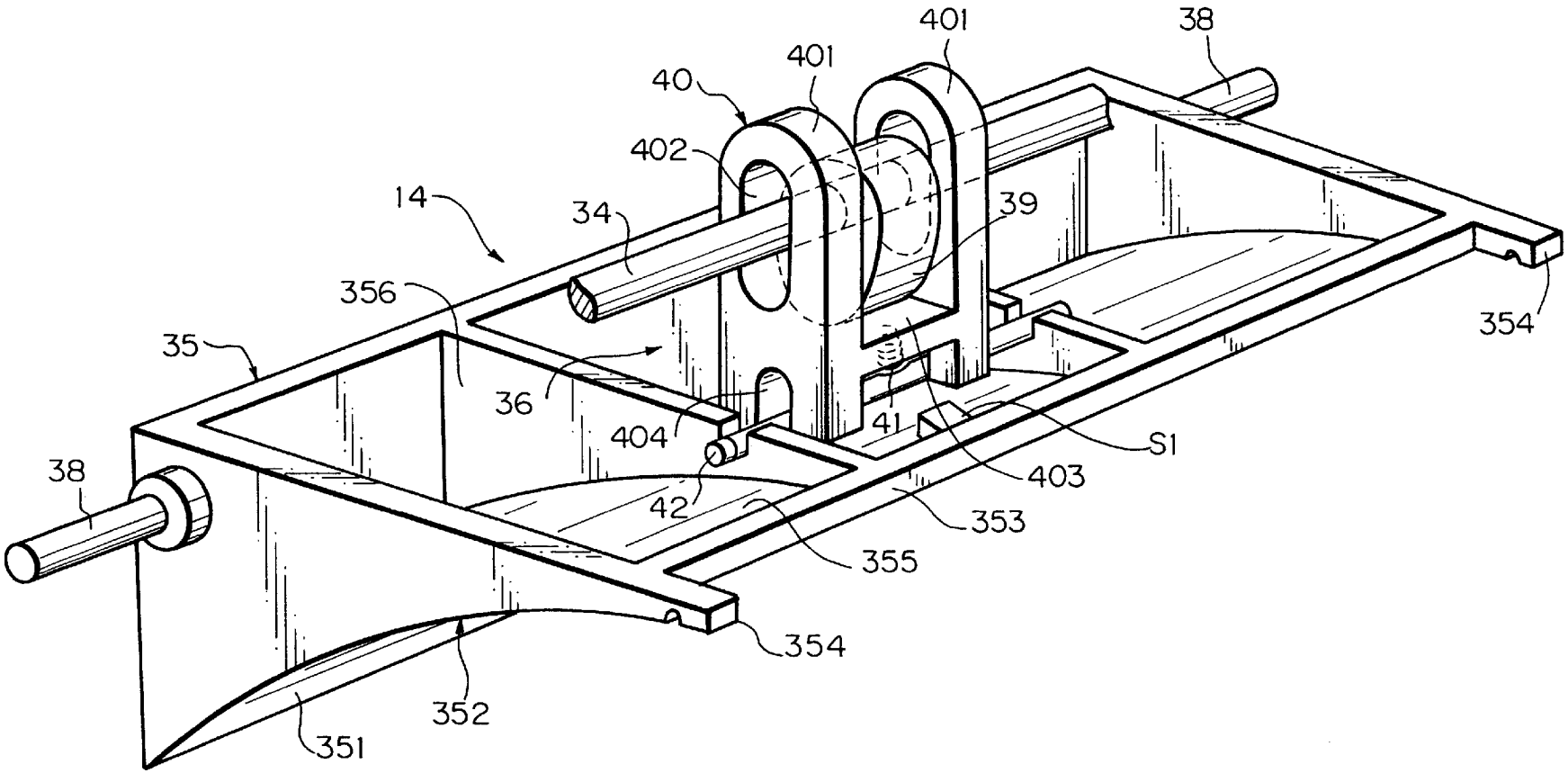
FIG. 5 is a perspective view of a deflector included in the illustrative embodiment.

The sheet deflecting means 14 is mounted on the elevatable frame 11 in addition to the cam drive means 13. As shown in FIGS. 1, 5 and 6, the sheet deflecting means 14 steers a sheet reached the transport surface f into a preselected bin 6 whose inlet a has been broadened by the cams 12. The sheet deflecting means 14 is generally made up of a deflector 36 and switching means 36 for switching the position of the deflector 36. The deflector 35 is mounted on the bracket 11*c*, which connect the front half 11*a* and rear half 11*b* of the frame 11, in parallel to the shaft 34. The deflector 35 is a bar-like molding of resin having a generally triangular cross-section, as illustrated. Pins 38 studded on both sides of the deflector 35 are respectively rotatably supported by pieces 111*c* extending not from both sides of the bracket 11*c*. The deflector 35 includes one edge 351 capable of slidingly contacting the transport surface f, a concave surface 352 extending from the edge 351 to the other edge 353, a pair of locking pieces 354 protruding from the front side and rear side of the edge 353, a convex surface 355 complementary to the concave surface 352, and a pair of walls 356 projecting from the convex surface 355 for reinforcement. A sheet sensor S1 is fitted on the intermediate portion of the convex surface 355 and has a sensing end shaped complementarily to the surface 352 so as not to obstruct the conveyance of a sheet.

The switching means 36 includes the shaft 34 disposed in the bracket 11*c*. A cam or deflector cam 39 is mounted on the intermediate portion of the shaft 34. A lever 40 is configured to sandwich the cam 39 while the shaft 34 is passed through the lever 40. A spring 41 is anchored at one end to the bottom of the lever 40 for adjusting a stroke and at the other end to the intermediate portion of a shaft 42. The shaft 42 is connected to the deflector 35 at its opposite ends.

Springs 44 each connect the respective looking piece 354 of the deflector 35 to the bracket 11*c;* the deflector 35 is angularly movable about the locking pieces 354. The springs 44 constantly bias the deflector 35 upward and hold it in contact with a stop 112*c* provided on the bracket 11*c*. This position of the deflector 35 is labeled q2 and will hereinafter be referred to as an inoperative or retracted position. The lever 40 has a pair of spaced lever portions 401 and a tie portion 403 connecting the lower portions of the lever portions 401. The lever portions 401 each are formed with a notch 404 open downward and accommodating the adjoining end portion of the shaft 42. When the deflector 35 is held in an operative or deflecting position q1, which will be described later, where it is pressed against the transport surface f, the springs 41 receive the resulting reaction via the shaft 42 and are compressed thereby. This successfully prevents the edge 351 of the deflector 35 from being pressed against the transport surface f by an excessive force and thereby insures the durability of the surface f and edge 351.

The shaft 34 included in the cam drive means 13 plays the role of a drive source for the switching means 36 at the same time. Specifically, the cam 39 mounted on the shaft 34 has a lift circle contacting a curved surface included in the tie portion 403 of the lever 40. The cam 39 is therefore capable of moving the deflector 35 from the inoperative position q2 to the operative position of against the action of the springs 44. The angular position of the cam 39 on the shaft 34 is preselected such that when the cams 12 interlocked with the shaft 34 maximize the distance between the trunnions 22 of nearby bins 6, i.e., when the trunnions 22 of nearby bins 6 contact the tops and bottoms of the cams 12, the lift circle of the cam 39 contacts the curved surface of the tie portion 403 and maintains the deflector 35 at the operative position q1.

The deflector 35 and cams 12 so sharing a single drive means 13 simplify the construction of the apparatus and reduces the weight and cost of the same. In addition, the shaft 34, deflector 35 and cams 12 are interlocked to each other and therefore insure stable synchronous movements. Specifically, as soon as the switching means 36 switches the deflector 35 to the operative position q1, the cams 12 maximize the distance between the inlet ends 601 of nearby bins 6 and thereby sufficiently broaden the inlet s of the underlying bin 6. Further, the relative position between the deflector 35 and the inlet s of the bin 6 contacting the bottoms of the cams 12 remains substantially constant without regard to the direction of movement of the frame 11, i.e., upward or downward. It follows that a sheet on the transport surface f is deflected toward the inlet a at a constant angle and can therefore be surely and stably introduced into the inlet a.

Moreover, when a sheet is absent at the deflecting position, the switching means 36 switches the deflector 35 from the operative position q1 to the inoperative position q2 where the deflector 35 is released from the transport surface f. This prevents the vertical transport section 19 and deflector 35 from sliding on each other and thereby enhances their durability. In addition, the deflector 35 acts on a sheet coming at a high speed as a brake and thereby stabilizes the behavior of the sheet in the bin 6. At this instant, a force acts only from the rear of the sheet (where an image is absent), so that an image is protected from disturbance.

Figure 13:
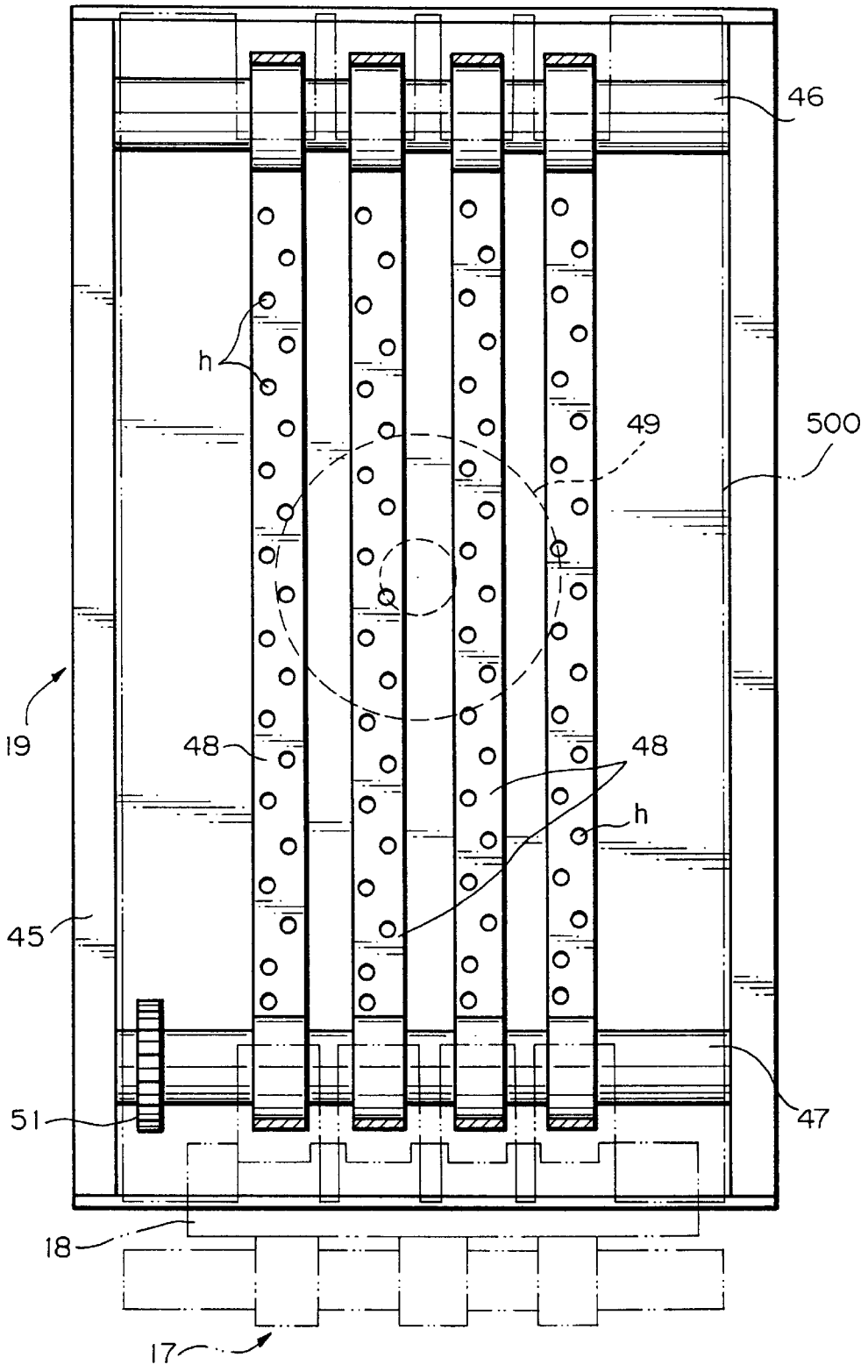
FIG. 13 is a partly taken away section showing the vertical transport section as seen from the side.

Referring again to FIG. 1, the vertical transport path 19 forming a part of the sheet feeding means 8 faces the inlet ends 601 of the bins 6. As shown in FIGS. 10 and 13, the transport section 19 includes a rectangular vertical frame 45 which is also rectangular in a side elevation. The frame 45 is hinged to the rear left frame portion 204 at its rear portion (upper portion as seen in FIG. 10). The front portion of the frame 45 (lower portion as seen in FIG. 10) is connected to the front left frame portion 204 by joint members not shown. The frame 45 is therefore rotatable about its front side in the horizontal direction, as desired. An upper roller 46 and a lower roller 47 are respectively rotatably supported by the upper and lower ends of the frame 45. A plurality of (four in the illustrative embodiment) endless belts 48 are passed over the two rollers 46 and 47. A suction fan 49 is positioned outside of and at a preselected distance from the belts 48. A wall 50 supports the suction fan 49 and isolates a space e around the belts 48 from the outside.

The belts 48 are formed of synthetic resin, rubber or similar material, and each is formed with a number of holes h (see FIG. 13). The suction fan 49 sucks air via the holes h of the belts 48 so as to retain a sheet on the transport surface f of the belts 48 conveying the sheet. As shown in FIGS. 2 and 13, the upper roller 46 and lower roller 47 are a driven roller and a drive roller, respectively. A drive gear 51 is mounted on one end of the lower roller 47 and connected to a drive motor 53 via a drive transmission mechanism 52.

As shown in FIGS. 2, 10 and 13, a guide plate 500 is positioned at the back of the transport surface f formed by the belts 48 in order to guide opposite ends of a sheet in the direction of transport. The guide plate 500 reduces, e.g., curling of opposite ends of the sheet protruding from the limited support area of the endless belts 48. Stated another way, the guide plate 500 allows a minimum number of belts 48 to suffice and thereby reduces the size of the drive motor 53 and saves energy. In addition, the guide plate 500 reduces the horizontal oscillation of the belts 48 simply extending in the up-and-down direction without being supported at their intermediate portions and thereby stabilizes the vertical transport of a sheet.

As shown in FIG. 1, the first switching section 16, horizontal transport section 17 and second witching section 18 are arranged in the space formed below the bin unit 7 and delimited by the lower vertical frame portions 202 and middle horizontal frame portions 203.

The first switching section 16 is movable between a sorting position p1 and a stacking position p2 respectively indicated by a solid line and a dash-and-dots line in FIG. 1. At the sorting position p1, the switching section 16 is connected to the horizontal transport section 17. At the stacking position p2, the switching section 16 conveys sheets toward the tray 15 beneath the horizontal transport section 17 and causes them to be simply stacked on the tray 15.

Figure 11:
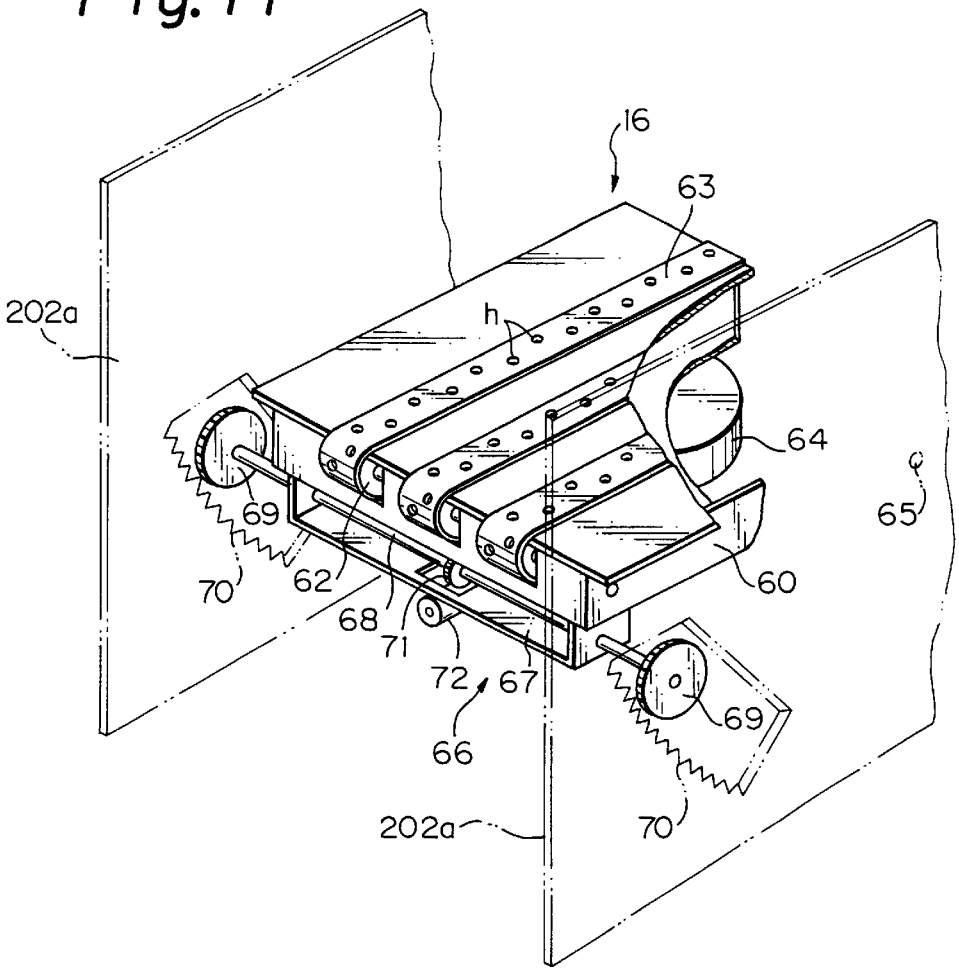
FIG. 11 is a perspective view showing a first switching section included in the illustrative embodiment.

The first switching section 16 receives a sheet from the outlet 3 of the printer 2 via the portion Z and conveys it in a direction X. The switching section 16 is implemented by a horizontal conveyor. As shown in FIG. 11, the conveyor is supported by the right lower frame portions 202*a* located at the front side and rear side, respectively. The frame portions 202*a* are connected to the body, not shown, of the printer 2 by brackets not shown.

Specifically, the first switching section 16 includes a flat box-like base 60 supported by the frame portions 202*a*. A drive pulley 61 and a driven pulley 62 are disposed in the base 60. A plurality of (three in the illustrative embodiments) endless belts 63 each are passed over the drive pulley 61 and driven pulley 62. The belts 63 are partly positioned on the top of the base 60. A suction fan 64 is mounted on the underside of the base 60 in order to suck a sheet onto the belts 63. The pulleys 61 and 62 are drive by a driveline including a chain, a sprocket and a motor, not shown.

The belts 63 are formed of synthetic resin, rubber or similar material, and each is formed with a number of holes h. The suction fan 64 sucks air from the inside of the base 60 in order to retain a sheet on the belts 63 conveying the sheet.

Pins 65 are horizontally studded on opposite outside walls of the inlet end of the base 60 coaxially with the drive pulley 61. The pins 65 are rotatably supported by the frame portions 202*a*, maintaining the inlet ends of the belts 63 and base 60 at the portion Z at all times. On the other hand, the outlet end of the base 60 is movable up and down about the pins 65.

Switching drive means 66 (see FIG. 11) is connected to the underside of the outlet end of the base 60. The switching drive means 66 causes the first switching section 16 to move about the pins 65 between the sorting position p1 and the stacking position p2 mentioned earlier. The switching drive means 66 includes a bracket 67 protruding from the underside of the base 60. A pair of pinions 69 are mounted on a shaft 68 which is, in turn, supported by the bracket 67. The front and rear frame portions 202*a* each are formed with a rack 70 meshing with one of the pinions 69. A worm wheel 71 is connected to the intermediate portion of the shaft 68. A worm 72 is held in mesh with the worm wheel 71. A motor 73 (see FIG. 10) drives the worm 72.

The racks 70 each have a sectorial shape whose center is defined by the pins 65. To move the first switching means 16 to the sorting position p1 or the stacking position p2, control means, not shown, feeds a signal to the motor 73 in response to a signal received from the printer 2. A first position sensor 74 outputs a motor stop command when the outlet end of the switching section 16 reaches the sorting position p1. A second position sensor 75 outputs a motor stop command when the switching section 16 reaches the stacking position p2. In response to the motor stop command output from the sensor 74 or 75, the motor 73 rotates the pinions 69 in the forward or reverse direction in order to hold the switching section at the sorting position p1 or the stacking position p2.

Figure 12:
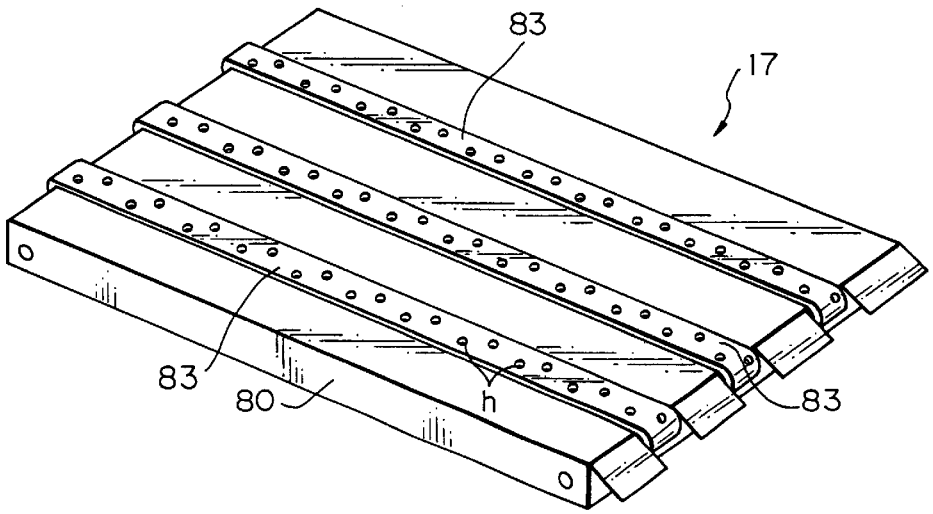
FIG. 12 is a perspective view of the horizontal transport section.

As shown in FIGS. 1, 10 and 12, the horizontal transport section 17 connectable to the second switching section 18 is also implemented as a conveyor including a flat box-like base 80. Pulleys 81 and 82 are disposed in the base 80. A plurality of (three in the illustrative embodiment) endless belts 83 are passed over the pulleys 81 and 82 and partly positioned on the top of the base 80. A suction fan 84 is mounted on the underside of the base 80 for sucking a sheet onto the belts 83. The pulleys 81 and 82 are driven by a driveline including a chain, sprocket and a motor, not shown. The base 80 is held substantially horizontally by the front and rear middle horizontal frame portions 203 via brackets not shown.

When the first switching section 16 is in its sorting position p1, the horizontal transport section 17 is capable of conveying a sheet handed over from the switching section 16 to the second switching section 18. The belts 83 are also formed of synthetic resin, rubber or similar material and formed with a number of holes h. The suction fan 84 sucks air from the inside of the base 80 in order to retain a sheet on the belts 83 conveying the sheet.

Figure 8:
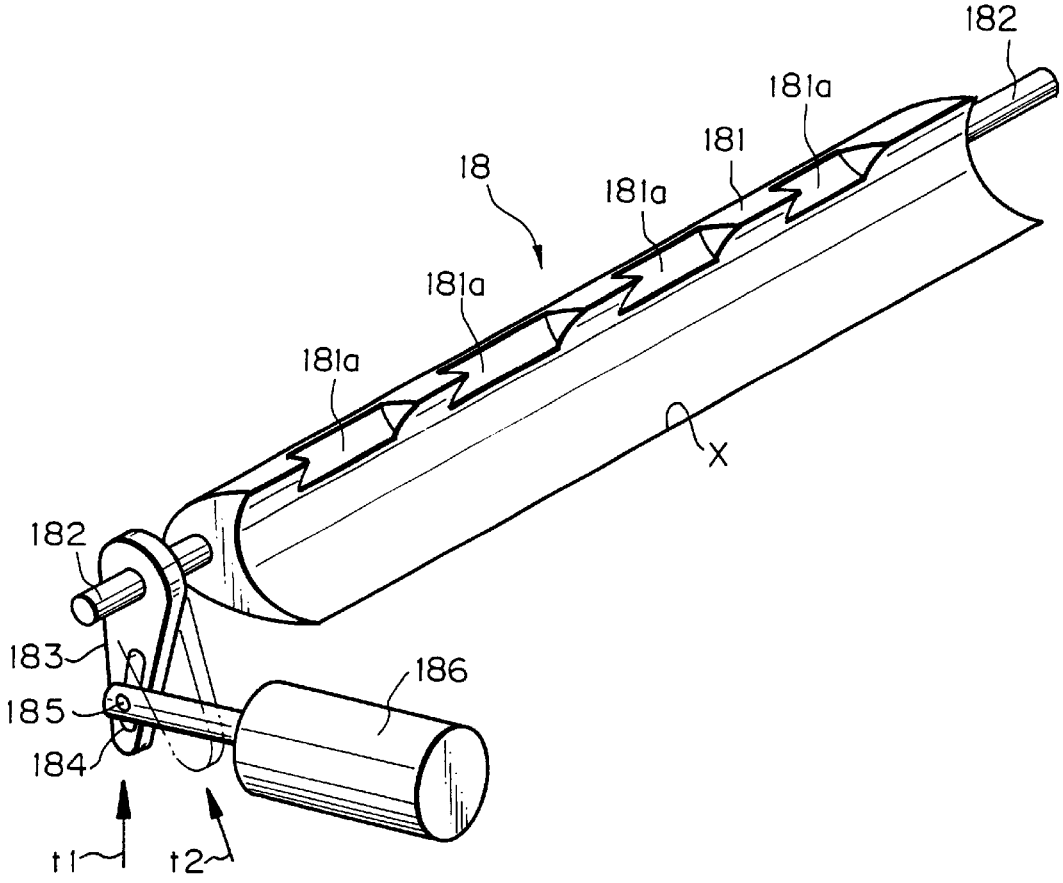
FIG. 8 is a perspective view showing a second switching section included in the illustrative embodiment.

As shown in FIGS. 1 and 8, the second switching section 18 includes a bar-like path selector or deflector 181 extending between the front and rear lower frame portions 202. Two pins 182 respectively protrude from the front side and rear side of the path selector 181 and rotatably supported by the frame portions 202 via brackets not shown. A lever 183 is affixed to one of the pins 182 and formed with an elongate slot 184. A solenoid 186 is connected to the slot 184 by the pin 182. A plurality of notches 181*a* are formed in the upper edge of the path selector 181 in order to reduce resistance to act on a sheet at the curved surface of the deflector 181.

When the solenoid 186 is not energized, the edge x of the path selector 181 is held in a usual position t1 indicated by a solid line in FIGS. 1 and 8. When the solenoid 186 is energized, the edge x is brought to an end-to-end connection position t2 indicated by a dash-and-dots line in FIG. 1. At the usual position t1, the edge x steers a sheet coming in through the horizontal transport section 17 to the vertical transport section 19. Assume that another printing storing apparatus is connected to the above apparatus 1 end-to-end in order to sort sheets to its bin tray unit also. Then, the edge x is switched to the end-to-end connection position when the solenoid 186 is energized. In this case, the edge x steers the sheet handed over from the horizontal transport section 17 to a position Z' (see FIG. 1) where the other apparatus faces the above apparatus 1.

When the first switching section 16 is held in its stacking position, it causes sheets sequentially coming in via the portion Z to be stacked on the tray 15 positioned beneath the horizontal transport section 17. As shown in FIG. 1, the tray 15 is supported by the bottom of the casing 20 via an elevation mechanism 90. The tray 15 is made up of a body 91, an end fence 92 extending upward from the downstream end of the body 91 in the direction of sheet transport, and a pair of side fences 93 extending upward from both side edges of the body 91. The side fences 93 are movable between an upright position indicated by a solid line and a position, not shown, fallen down outward. In addition, the side fences 93 are movable toward and away from each other via a conventional mechanism. A specific form of the tray 15 is taught in Japanese Patent Laid-Open Publication No. 7-41238 mentioned earlier.

The operation of the apparatus 1 will be described hereinafter. The printer 2 sequentially executes conventional steps for making a master and producing a trial printing. If the trial printing is acceptable, the printer 2 is caused to start a printing step. Assume that the operator of the printer 2 does not select a sort mode using the apparatus 1 on the operation panel, not shown, of the printer 2.

Then, the printer 2 determines that a mode other than the sort mode is selected, and drives the elevation mechanism 90 in order to move the tray 15 to a reference position u1 (solid line in FIG. 1). At the same time, the printer 2 drives the switching drive means 66 in accordance with the output of the second position sensor 75, moving the first switching section 16 to the stacking position p2. As a result, the outlet end of the switching section 16 is caused to face the tray 15. Further, the printer 2 drives the belts 63 and suction fan 64 of the switching section 16. Then, the printer 2 discharges a sheet via its outlet 3 face up, i.e., with an image facing upward. The sheet is introduced into the apparatus 1 via the position Z and conveyed by the switching section 16 to the body 91 of the tray 15. The tray 15 may be so controlled as to sequentially move downward toward a position u2 below the reference position u1 in accordance with the number of sheets sequentially stacked thereon. When the sort mode is selected on the printer 2, the trial printing is driven out to the tray 15.

When the sort mode using the apparatus 1 is selected on the printer 2, the printer 2 recognized the sort mode and drives the switching drive means 66 in accordance with the signal of the first position sensor 74 in order to move the first switching section 16 to the sorting position p1. As a result, the outlet end of the switching section 16 aligns with the inlet end of the horizontal transport section 17. Further, the printer 2 drives the belts 63, 83 and 48 and suction fans 64, 84 and 49 of the first switching section 16, horizontal transport section 17, and vertical transport section 19, respectively.

Subsequently, the printer 2 sequentially discharges via the outlet 3 sheets, or printings, derived from a first document and equal in number to desired sets of printings. The sheets driven out of the printer 2 face up are sequentially conveyed via the position Z, first switching section 16, horizontal transport section 17 and second transport section 18 to the deflection surface f of the vertical transport section 19.

Further, to introduce the first sheet into the first or bottom bin tray 6, the printer 2 switches the cams 12 and deflector 35 of the elevatable frame 11 to their reference positions. At the reference position, the cams 12 are positioned right above the front and rear trunnions 22 of the first bin tray 6. At the same time, the deflector 35 is caused by the deflector cam 39 to move from the inoperative position q2 to the operative position q1.

In the above condition, when the first sheet rises along the transport surface f, it is separated from the surface f by the deflector 35 and introduced into the inlet a of the first bin tray 6 whose trunnions 22 are positioned right below the cams 12. In this manner, the sheet coming in through the position Z is caused to make a U-turn by the sheet feeding means 8 and sheet deflecting means 14 and laid on the bin tray 6 face down. At this instant, the end fence 27 of the bin tray unit 7 has been positioned such that the sheet introduced into the bin tray 6 via the inlet a hits against the end fence 27 at a preselected position matching with its size.

The sheet sensor S1, FIG. 5, outputs a signal representative of the trailing edge of the sheet introduced into the first bin tray 6 via the inlet a. In response, a bin drive signal allowing the bins 6 to be fed appears. In response, the printer 2 drives the motor 29 of the cam drive means 13 and thereby causes the front and rear cams 12 to make one rotation. As a result, the trunnions 22 of the second bin tray 6 are lowered by the distance L1 toward the trunnions 22 of the first or bottom bin tray 6 relative to the cams 12. Specifically, the trunnions 22 of the second or overlying bin tray 6 move downward along the cam grooves 122 of the cams 12 and rest on the trunnions 22 of the bottom bin tray 6, i.e., stopped by the latter. As a result, the cams 12 and deflector 35 are raised together with the frame 11. On completing one rotation, the cams 12 are brought to positions where their bottoms contact the trunnions 22 of the overlying bin tray 6. Consequently, the inlet end 601 of the overlying bin tray 6 is broadened while the deflector 35 is moved to the operative position q1 by the deflector cam 39.

When the second sheet arrives at the deflector 35, the deflector 35 steers the sheet into the inlet a of the second or overlying bin 6 whose trunnions 22 are held in contact with the bottoms of the cams 12. This is followed by the same procedure as described in relation to the first sheet. As soon as sheets equal in number to the desired sets of printings are sorted into consecutive bins 6, the printer 2 reverses the motor 29 of the cam drive means 13 by an amount corresponding to the desired number of sets and deenergizes it at the previously mentioned reference or bottom position.

During the above sort mode operation, the sheet sensor S positioned on the convex surface 52 of the deflector 35 and adjoining the edge 353 senses the consecutive sheets. The sheet sensor S is implemented by a reflection type optical sensor. With the sheet sensor S1, it is possible to surely recognize the entry of each sheet into a particular bin 6. When the sheet sensor S1 does not sense a sheet within an expected period of time or when it continuously senses a sheet over more than a preselected period of time, a control system built in the printer 2 determines that a jam has occurred, interrupts the printing operation, and displays a message alerting the operator to the jam. It is therefore not necessary to assign a particular sheet sensor to each bin 6.

In parallel with the above sort mode operation, the printer 2 produces a master with a second document and again discharges the resulting sheets or printings correspond in number to the desired sets of printings. A trial printing derived from the second master is also steered to the tray 15. The first sheet carrying the image of the second document is separated from the transport surface f by the deflector 35 and introduced into the bin 6 having its inlet a broadened. The first sheet is stacked face down on the sheet existing on the above bin 6. When the sheet sensor S senses the trailing edge of the first sheet, a bin drive signal appears as during the previous operation. In response, the printer 2 again drives the motor 29 of the cam drive means 13 in order to rotate the cams 12, so that the trunnions 22 of the second bin 6 from the bottom are moved downward by the distance L1 relative to the cams 12.

Consequently, the cams 12 and deflector 35 are raised together with the frame 11 until the bottoms of the cams 12 contact the trunnions 22 of the second bin 6 from the bottom. At this instant, the inlet a of this bin 6 is broadened while the deflector 35 is switched from the inoperative position q2 to the operative position q1 by the deflector cam 39. On the arrival of the second sheet, it is inserted into the inlet a of the above bin 6 whose trunnions 22 contact the bottoms of the cams 12. After the second sheet has been fully accommodated in the second bin 6 from the bottom, the procedure described with the first sheet is repeated. When sheets derived from the second document are fully sorted into the preselected bins 6, the printer 2 again controls the motor 29 of the cam drive means 13 for causing the apparatus 1 to wait for sheets corresponding to the third document.

As stated above, sheets derived from a desired number of documents are sequentially sorted into and stacked on the consecutive bins 6. The operator sequentially takes out the sheet stacks from the bins 6 between the left frame portion 204 and the right frame portion 205 toward the operator. If desired, the operator may cause the stapler 26 to sequentially staple the sheet stacks positioned on the bins 6 before taking them out.

In the illustrative embodiment, the frame 11 is moved upward from a reference position where the cams 12 are located at the bottom. This is because the trunnions 22 and therefore the bins 6 move downward with a minimum of load acting thereon. This promotes rapid movement of the bins 6. If this advantage is not necessary, the frame 11 may be moved downward from a reference position where the cams 12 are positioned at the top. Of course, an arrangement may be made such that the cams 12 are moved downward for one document and then moved upward for the next document without being returned to its reference position each time.

As stated above, the apparatus 1 includes the cams 12 and cam drive means 13 mounted on the elevatable frame 11 and moves them up and down together with the frame 11. Therefore, the bearing portions Y bearing the rotation of the cams 12 and the front support portions 27 bearing the up-and-down slide of the frame 11 are independent of each other. This reduces the load to act on the individual bearing, easily allows the bins to be rapidly opened and closed, and increase durability. In addition, the illustrative embodiment is easy to machine and achieves high accuracy.

In the illustrative embodiment, the cam drive means 13 implements a drive source for the cams 12 and a drive source for the deflector switching means 34 at the same time, simplifying the construction and reducing the weight and cost. Further, the drive shaft 34 operates both of the cams 12 and deflector 35 and easily allows the inlet of the bin 6 facing the bottoms of the cams 12 to be broadened and the deflector 35 to be switched to the operative position q1 in synchronism with each other. This obviates the need for synchronization control which would sophisticate the apparatus.

Figure 14:
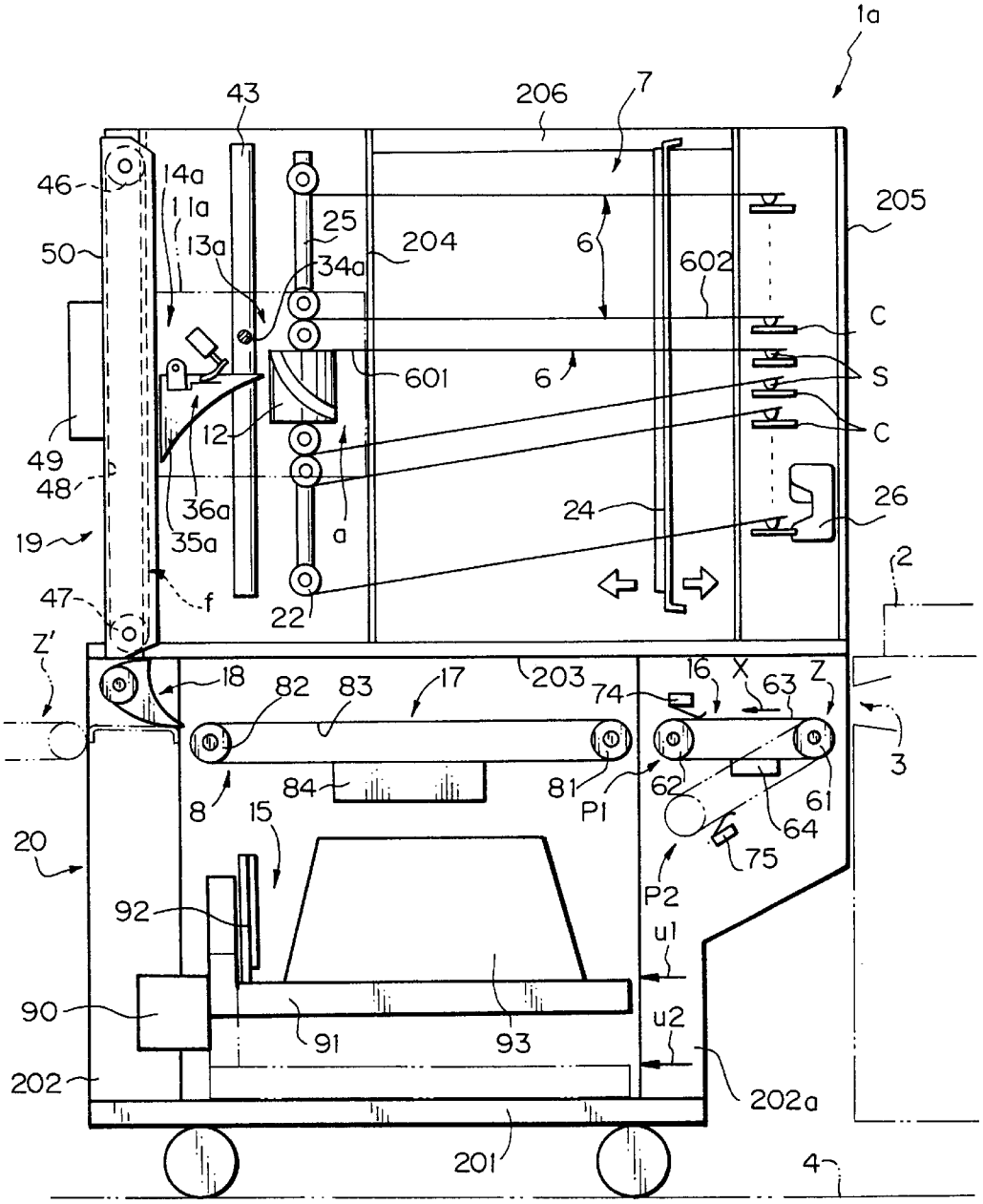
FIG. 14 is a sectional front view showing an alternative embodiment of the present invention.
Figure 15:
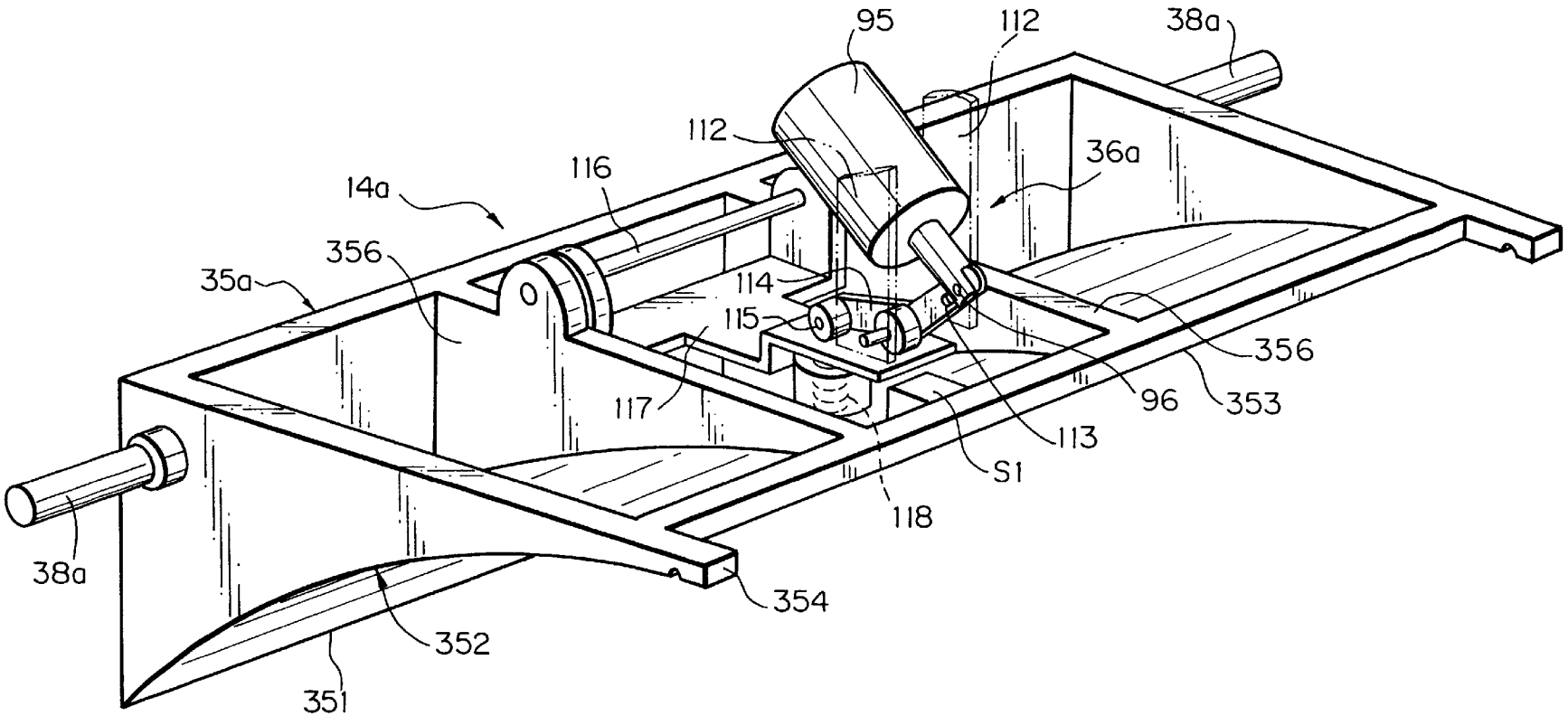
FIG. 15 is a perspective view of a deflector included in the embodiment shown in FIG. 14.
Figure 16:
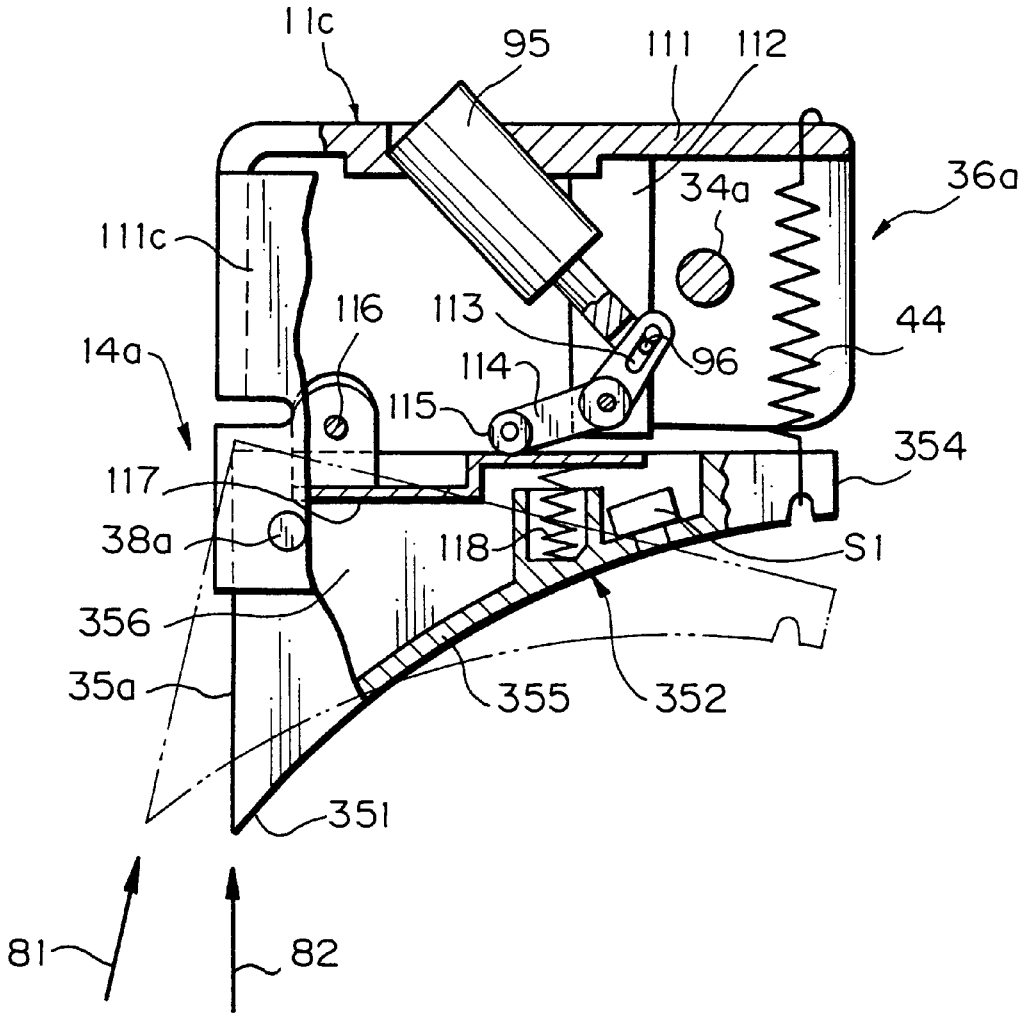
FIG. 16 is a partly taken away section showing the deflector of FIG. 15.

An alternative embodiment of the present invention will be described with reference to FIGS. 14–16. In the previous embodiment, the shaft 34 of the cam drive means 13 operates both of the cams 12 and deflector 35. A sheet storing apparatus, generally 1*a*, to be described includes exclusive switching means 36*a* assigned to the deflector 35*a*. This embodiment is similar to the previous embodiment except for cam drive means 13*a* and sheet deflecting means 14*a*. In FIGS. 14–16, structural elements identical with the structural elements shown in FIGS. 1–13 are designated by like reference numerals and will not be described specifically in order to avoid redundancy.

As shown in FIG. 14, the cam drive means 13*a* is identical with the cam drive means 13, FIG. 3, except that it lacks the deflector cam 39. A shaft 34*a* extends over the front half 11*a* and rear half 11*b* of the elevatable frame 11. The rotation of the shaft 34*a* is transferred to the cams 12 via gears, drive pulleys, drive belts and cam pulleys, not shown, (identical with the members shown in FIG. 3) arranged on the front half 11*a* and rear half 11*b*.

In the above configuration, the cams 12 feed the front and rear trunnions 22 of one bin 6 upward or downward at the same time by the distance L1 by one rotation thereof, thereby raising or lowering the inlet end 601 of the bin 6. The bin 6 newly facing the bottoms of the cams 12 due to its movement relative to the cams 12 has its inlet a broadened.

Sheet deflecting means 14*a* is movable up and down together with the cams 12 for steering a sheet reached the transport surface f toward the bin 6 whose inlet a has been broadened by the cams 12. The sheet deflecting means 14*a* is made up of a deflector 35*a* and switching means 36*a* for switching the deflector 35*a*. As shown in FIG. 16, the bracket 11*c* connecting the front half 11*a* and rear half 11*b* of the frame 11 is implemented as an elongate frame with which a shaft 34*a* is movably engaged. In addition, the bracket 11*c* rotatably supports the deflector 35*a* in parallel to the shaft 34*a*. The switching means 36*a* is mounted on the deflector 35*a*. Pins 38*a* studded on both sides of the deflector 35*a* are respectively rotatably supported by the pieces 111*c* extending out from both sides of the bracket 11*c*. The deflector 35*a* includes one edge 351 capable of slidingly contacting the transport surface f, a concave surface 352 extending from the edge 351 to the other edge 353, a pair of locking pieces 354 protruding from the front side and rear side of the edge 353, and a pair of springs 44 each biasing the respective locking piece 354 upward toward the bracket 11*c*, i.e., biasing the edge 351 away from the transport surface f.

As shown in FIGS. 15 and 16, the switching means 36*a* includes a solenoid 95 supported by a top wall 111 included in the bracket 11*c* via a bracket not shown. A pair of brackets 112 extend downward from the top wall 111 in such a manner as to hold the solenoid 95 therebetween. A lever 114 is rotatably supported by the lower ends of the brackets 112. An elongate slot 113 is formed in one end of the lever while a pin 96 included in the solenoid 95 is received in the slot 113. A roller 115 is rotatably mounted on the other end of the lever 114. A pair of ribs 356 protrude from the convex wall 355 complementary to the concave surface 352. A bent plate 117 is pivotally connected to the ribs 356 via a pin 116. A spring 118 for stroke adjustment is anchored at its bottom to the convex wall 355. The top of the spring 118 constantly biases the free end of the bent plate 117 toward the roller 115. In addition, the sheet sensor S1 is positioned on the top of the convex wall 355 and has its sensing end configured complementarily to the concave surface 352 so as not to obstruct the conveyance of a sheet.

When the solenoid 95 is not energized, it cooperates with the springs 44 to maintain the deflector 35*a* at the inoperative or retracted position q2. When the solenoid 95 is energized, it switches the deflector 35*a* to the operative position q1 against the action of the springs 44. At the operative position q1, the deflector 35*a* presses the transport surface f with its edge 351. However, the resulting reaction is transferred from the lever 35*a* to the levers 114 via the spring 118 and bent plate 117. The spring 118 therefore absorbs the above reaction and prevents the edge 351 from being strongly pressed against the transport surface f. This insures the durability of the edge 351 and transport surface f.

The operation of the apparatus 1*a* is identical with the apparatus 1 except for the operation of the cam drive means 13*a* and that of the switching means 36*a* and will not be described specifically.

The apparatus 1*a* operates in the same manner as the apparatus when a mode other than the sort mode, i.e., the stack mode is selected on the printer 2. On the other hand, in the sort mode, the printer 2 switches the first switching section 16 to the sorting position p1 (solid line shown in FIG. 14) and then drives the sheet feeding means 8. A sheet driven out of the printer 2 is routed through the position Z, first switching section 16 and horizontal transport section 17 to the transport surface f of the vertical transport section 19.

At this instant, to distribute the first sheet to the first or bottom bin 6 held at the reference position, the printer 2 holds the cams 12 of the frame 11 at the reference position. At the reference position, the bottoms of the cams 12 are respectively positioned on the front and rear trunnions 22 of the first bin 6. At the same time, the solenoid 95 is turned on to hold the deflector 35*a* at the operative position q1.

When the first sheet rises along the transport surface f, the deflector 35*a* steers the sheet and inserts it into the inlet a of the first bin 6. As a result, the first sheet is laid on the first bin 6 face down. At this time, the end fence 24 of the bin tray unit 7 is held at a position matching with the size of sheets to be used.

The sheet sensor S1 outputs a signal on sensing the first sheet inserted into the inlet a of the first bin 6. In response, the printer 2 drives the cam drive means 13*a* so as to cause the cams 12 to make one rotation. As a result, the trunnions 22 of the second bin member 6 are moved downward by the distance L1 relative to the cams 12 until the bottoms of the cams 12 contact the above trunnions 22. This broadens the inlet a of the second bin 6. On the other hand, the solenoid 95 is once deenergized in response to the bin drive signal, maintaining the deflector 35*a* at the inoperative position q2. On the elapse of a preselected period of time necessary for the frame 11 to elevate, the solenoid 95 is again energized to switch the deflector 35*a* to the operative position q1.

When the second sheet arrives at the deflector 35*a*, the deflector 35*a* steers the sheet and inserts it into the broadened inlet a of the second bin 6 whose trunnions 22 are held in contact with the bottoms of the cams 12. After the second sheet has been fully accommodated in the second bin 6, the procedure described in relation to the first sheet is repeated. When sheets corresponding in number to desired sets of printings are fully distributed to the consecutive bins 6, the printer 2 controls the rotation of the motor 29 of the cam drive means 13*a*, turns off the solenoid 95 in order to maintain the deflector 35*a* at the inoperative position, and returns the cams 12 to the reference position.

Subsequently, the printer 2 sequentially discharges sheets derived from the second document and corresponding in number to the desired sets of printings. At this instant, the solenoid 95 is energized to switch the deflector 35*a* to the operative position q1. The deflector 35 at the position q1 steers the first sheet derived from the second document into the broadened inlet a of the bottom bin 6. As a result, the sheet is stacked on the sheet existing on the bottom bin 6 face down. So long as the sheet sensor S1 adequately outputs a signal representative of the first sheet, a bin drive signal for allowing the bins 6 to be fed appears. In response, the printer 2 controls the motor (29, FIG. 3) of the cam drive means 13*a* in the same manner as described in relation to the first document. The motor causes the cams 12 to make one rotation to thereby lower the trunnions 22 of the second bin 6 from the bottom by the distance L relative to the cams 12. Consequently, the bottoms of the cams 12 contact the trunnions 22 of the second bin 6 from the bottom, broadening the inlet a of the bin 6.

On the other hand, the solenoid 95 is once deenergized in response to the bin drive signal, maintaining the deflector 35*a* at the inoperative position q2. On the elapse of the preselected period of time necessary for the frame 11 to elevate, the solenoid 95 is again energized to switch the deflector 35*a* to the operative position q1. When the second sheet derived from the second document arrives at the deflector 35*a*, the deflector 35*a* steers the sheet into the inlet a of the second bin 6 from the bottom whose trunnions contact the bottoms of the cams 12. As a result, the second sheet is laid on the sheet existing in the second bin 6 from the bottom. This is followed by the same operation as with the first sheet. In this manner, sheets corresponding in number to the desired sets of printings are sorted into the consecutive bins 6. When a sheet is inserted into the inlet a of top one of the bins corresponding in number to the desired sets of printings, the printer 2 causes the cam drive means 13*a* to turn off the solenoid 95. As a result, the deflector 35*a* is returned to the inoperative position q2. In this condition, the apparatus 1 waits for sheets corresponding to the third document.

As stated above, in the sort mode, sheets derived from a desired number of documents are sequentially sorted into and stacked on the consecutive bins 6. The operator sequentially takes out the sheet stacks from the bins 6 toward the operator. If desired, the operator may cause the stapler 26 to sequentially staple the sheet stacks positioned on the bins 6 before taking them out.

The apparatus 1*a* described above causes the cam drive means 13*a* to drive the cams 12 and causes the solenoid of the switching means 36*a* to switch the deflector 35*a* of the sheet deflecting means 14*a*. The cam drive means 13*a* and sheet deflecting means 14*a* are operated in synchronism with each other by the bin drive signal controlled by the output of the sheet sensor S1. The cam drive means 13*a* and switch means 36*a* are independent of each other. Therefore, despite that both the cams 12 and deflector 35*a* are mounted on the frame 11, there can be relatively easily implemented the freedom of relative position. It follows that the position and shape of the cams 12 and those of the deflector 35*a* can be so adjusted as to steer a sheet into the inlet 1 more stably.

In the apparatus 1*a*, too, the bearing portions Y bearing the rotation of the cams 12 and the front support portions 27 bearing the up-and-down slide of the frame 11 are independent of each other. This reduces the load to act on the individual bearing, easily allows the bins to be rapidly opened and closed, and increase durability. Particularly, when a sheet is absent at the deflecting position, the switching means 36*a* causes the deflector 35*a* to retract from the operative position q1 of the inoperative position q2 by using the solenoid 95. The deflector 35*a* can therefore be spaced from the transport surface f. This reduces sliding contact between the vertical transport section 18 and the deflector 35*a* and thereby enhances their durability. Particularly, this is successful to promote free layout.

As shown in FIGS. 15 and 16, the switching means 36*a* of the apparats 1*a* transfers a force output from the solenoid 95 to the deflector 35*a* via the levers 114, bent plate 117, and spring 118. Alternatively, a lever, not shown, may be affixed to the shaft 38*a* of the deflector 35*a* and directly connected to the switching means including the solenoid 95 via a link mechanism not shown. In this case, too, the cams 12 and deflector 35*a* can operate independently of each other. Although both the cams 12 and deflector 35*a* are mounted on the frame 11, there can be relatively easily implemented the freedom of relative position and therefore free layout and free configuration.

Figure 17:
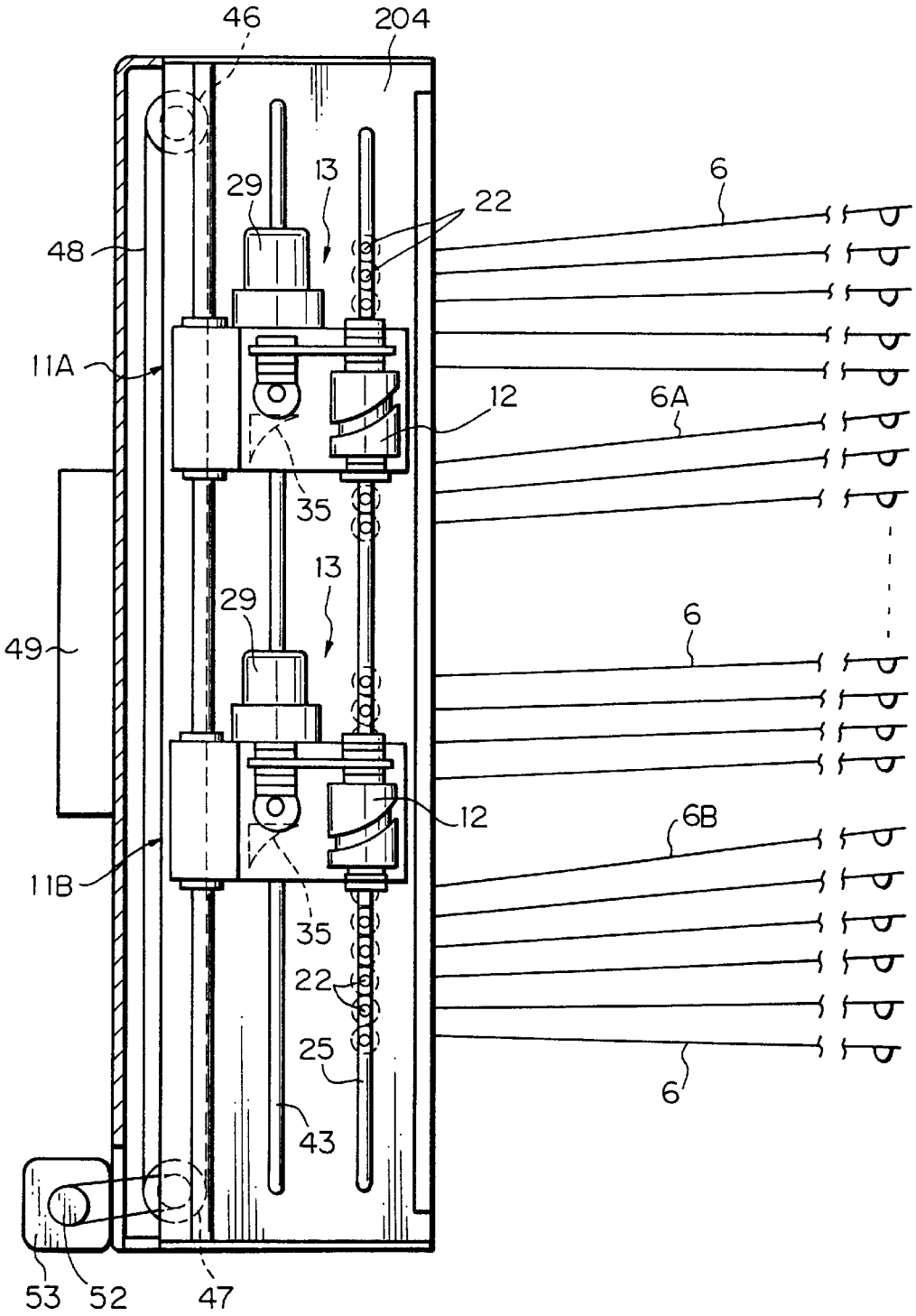
FIG. 17 is a partly taken away front view showing a left frame portion and an elevatable frame representative of a modification of either one of the illustrative embodiments.

In each of the constructions shown in FIGS. 1 and 16, a single elevatable frame 11 or 11*a* faces the bin unit 7 and includes the cams 12 for sequentially broadening the inlets a of the consecutive bins 6 and a single deflector 35 or 25*a* for deflecting sheets. FIG. 17 shows a modification of such a construction. As shown, a plurality (two in FIG. 17) of elevatable frames 11A and 11B are positioned one above the other at a preselected distance. The frames 11A and 11B each includes the respective cams 12 and deflector 35, FIG. 1. Although the lower frame 11B must bear the weight of all of the bins 6 above the frame 11B and the weight of the upper frame 11A via the trunnions 22, sheets can be alternately distributed to two bin members 6A and 6B spaced by a preselected number of bins in the up and down direction and having their inlets a broadened. With this construction, it is possible to double a period of time available for the switching of the cams 12 of the frames 11A and 11B, compared to the construction of FIG. 1, and therefore to easily speed up the operation of the apparatus.

In the embodiments shown and described, the cams 12 are rotated in response to the output of the sheet sensor S1 representative of the trialing edge of a sheet. This allows the cams 12 to move to the next bin 6 after a sheet has been fully accommodated in a designated bin 6. This kind of control, however, prevents the sheet storing apparatus to adapt to the high-speed operation of the printer 2. Specifically, when the distance between consecutive sheets is reduced, the cams 12 cannot rotate at a timing early enough to meet the reduced distance. It follows that a printing speed available with the printer 2 having a high-speed printing function must be intentionally reduced.

Hereinafter will be described another alternative embodiment of the present invention making most of the high-speed feature of the printer 2. While the embodiment to be described is basically practicable with either one of the construction of the apparatus 1 and that of the apparatus 1*a*, the following description will concentrate on the construction of the apparatus 1*a* by way of example. Further, only structural parts and elements unique to this embodiment will be described.

This embodiment pays attention to the fact that the deflector 35*a* does not restrict a sheet, and the fact that a sheet can enter even the bin 6 whose inlet is being closed due to the rotation of the cams 12. In the illustrative embodiment, even before the deflector 35*a* senses the trailing edge of a sheet, the cams 12 are rotated as soon as a condition allowing the sheet to be safely introduced into the bin 6 without any obstruction is reached. This is successful to adapt the apparatus 1*a* to the high-speed operation of the printer 2.

The illustrative embodiment determines a timing for causing the cams 12 to start rotating on the basis of information representative of the leading edge of a sheet and output from the sheet sensor S1. Specifically, the cams 12 start rotating on the elapse of a preselected period of time (msec) since the output of a signal representative of the leading edge of a sheet from the sheet sensor S1. Let this period of time be referred to as a delay time. The delay time depends on a sheet size as measured in the direction of transport.

Figure 20:
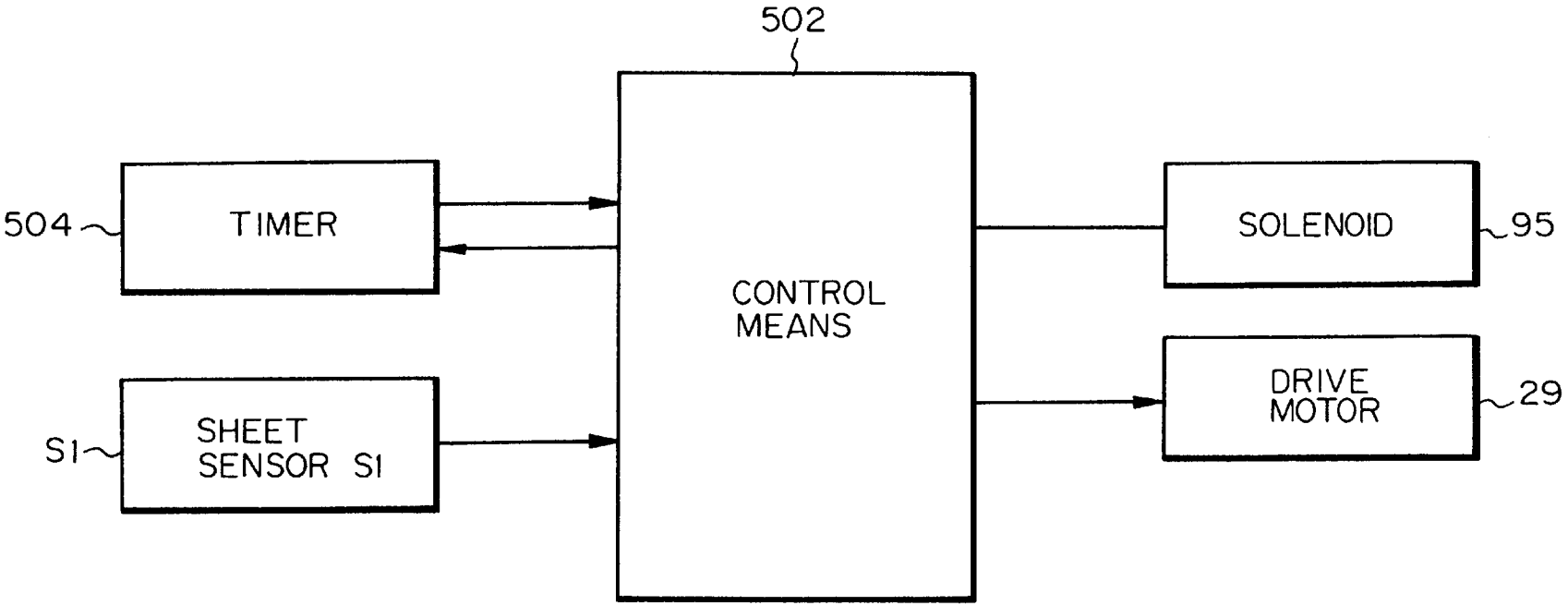
FIG. 20 is a block diagram schematically showing a control system representative of another alternative embodiment of the present invention.

FIG. 20 shows a control system for practicing this embodiment. As shown, the control system includes control means 502 implemented as a microcomputer including a CPU (Central Processing Unit), and I/O (Input/Output) interface, a ROM (Read Only Memory), and a RAM (Random Access Memory). The ROM stores delay times each corresponding to a particular sheet size and determined by, e.g., experiments beforehand. The control means 502 controls, in response to information output from the sheet sensor S1, the timer 504, the solenoid 95 of the switching means 36*a*, the motor 29 of the cam drive means 13*a*, etc.

Figure 21:
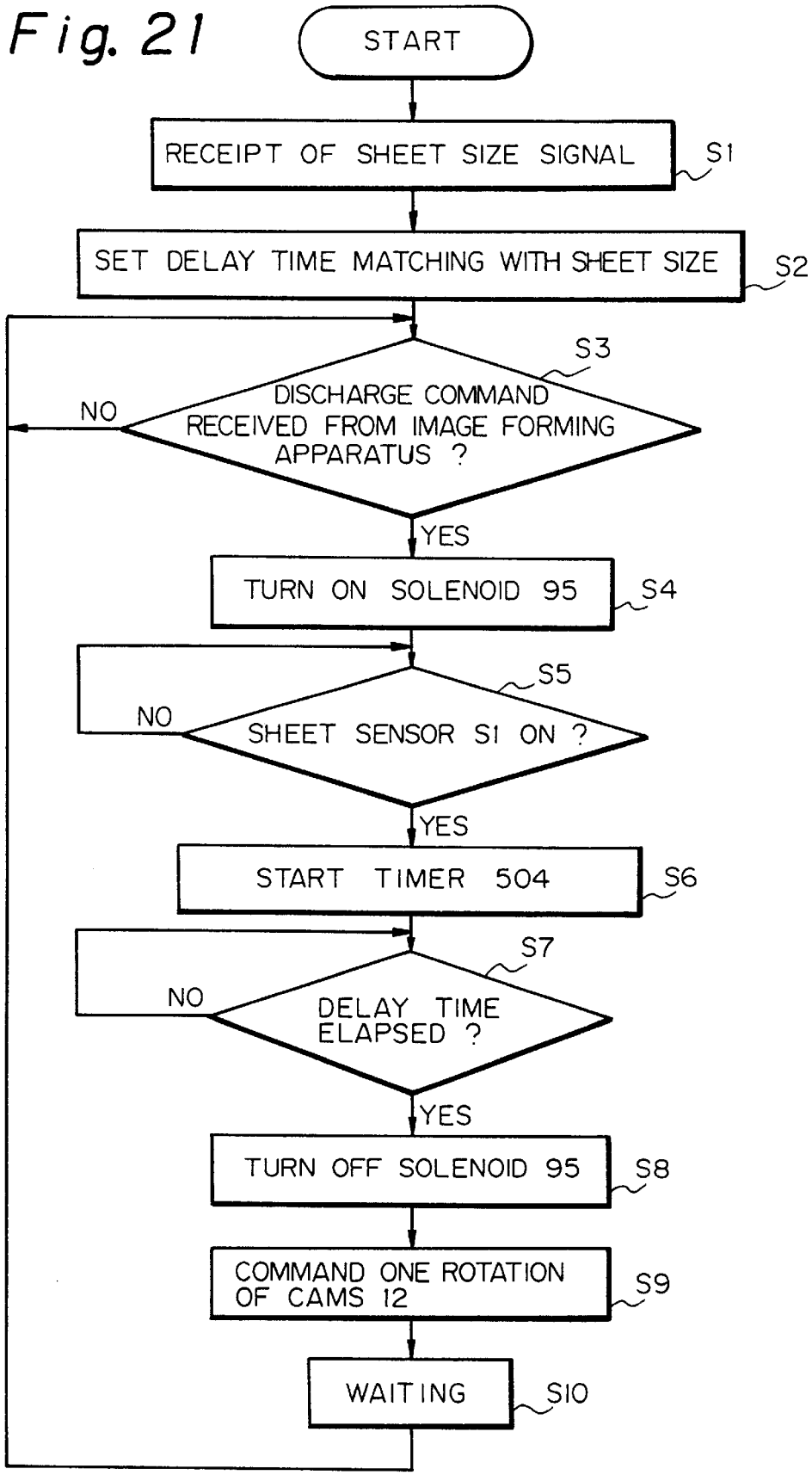
FIG. 21 is a flowchart demonstrating a specific operation of the embodiment shown in FIG. 20.

Reference will be made to FIG. 21 for describing a specific operation of the illustrative embodiment. The control means 502 receives a sheet size signal from sheet size sensing means or sheet size setting means included in the apparatus 1*a*, from an image forming apparatus (stencil printer 2), or a personal computer connected to the image forming apparatus (step S1). In response, the control means 502 reads a delay time matching with the received sheet size out of the ROM and sets the delay time in a timer 504 (step S2). Then, the control means 502 determines whether or not a sheet discharge command has been received from the image forming apparatus (step S3). On the receipt of the sheet discharge command (YES, step S3), the control means 502 turns on the solenoid 95 so as to move the deflector 35*a* to its operative or deflecting position (step S4).

Subsequently, the control means 502 determined whether or not the sheet sensor S1 has turned on, i.e., detected the leading edge of a sheet (step S5). If the answer of the step S5 is YES, the control means 502 causes the timer 504 to start counting the delay time (step S6). The control means 502 determines whether or not the delay time has elapsed on the basis of the output signal of the time 504 (step S7). If the answer of the step S7 is YES, the control means 502 turns off the solenoid 95 in order to return the deflector 35*a* to its inoperative position (step S8). Then, the control means 502 sends a one-rotation command to the drive motor 29. In response, the drive motor 29 causes the cams 12 to make one rotation (step S9). While the cams 12 are in rotation, the control means 502 waits for the next sheet discharge command (WAITING, step S10).

The above delay time control allows the cams 12 to rotate while minimizing the period of time necessary for the sheet deflecting means 14*a* to steer a sheet, so that the apparatus 1*a* can adapt itself to high-speed printing.

Generally, a sheet storing device of the type described does not fully close the inlet of each bin 6. Even in a construction of the kind fully closing the inlet of the bin 6, the above delay time control can implement an utmost timing operation which causes the inlet to close almost immediately after the entry of the trailing edge of a sheet in the bin 6.

Now, even sheets of the same size each enter the bin 6 at a particular speed or each are decelerated at a particular rate on leaving the deflector 35*a*, depending on the position of the bin 6. This is because each sheet is subjected to a particular degree of resistance (restriction) at the horizontal transport section 17 and vertical transport section 19, depending on the position of the designated bin 6.

In light of the above, a particular delay time may be determined for each sheet size by, e.g., experiments, on the basis of the sheet size and bin number and stored in the ROM. In this case, the control means 502 will select an optimal delay time matching with the sheet size signal and a bin number signal received from the image forming apparatus. This kind of control adapts to the actual behavior or a sheet and thereby reduces a jam rate in the delay time control.

Figure 22:
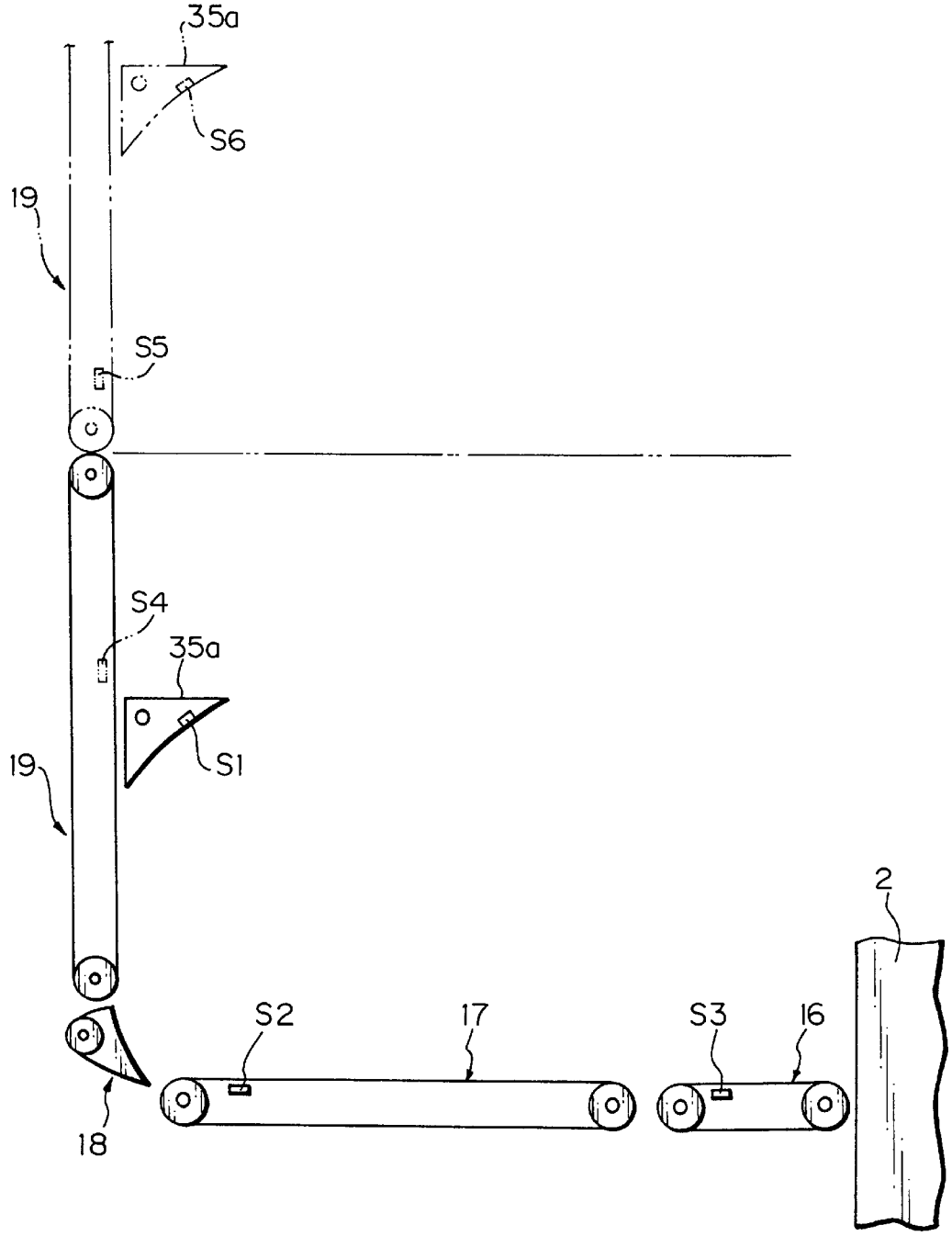
FIG. 22 shows a specific arrangement of sheet sensors included in a further alternative embodiment of the present invention.
Figure 23:
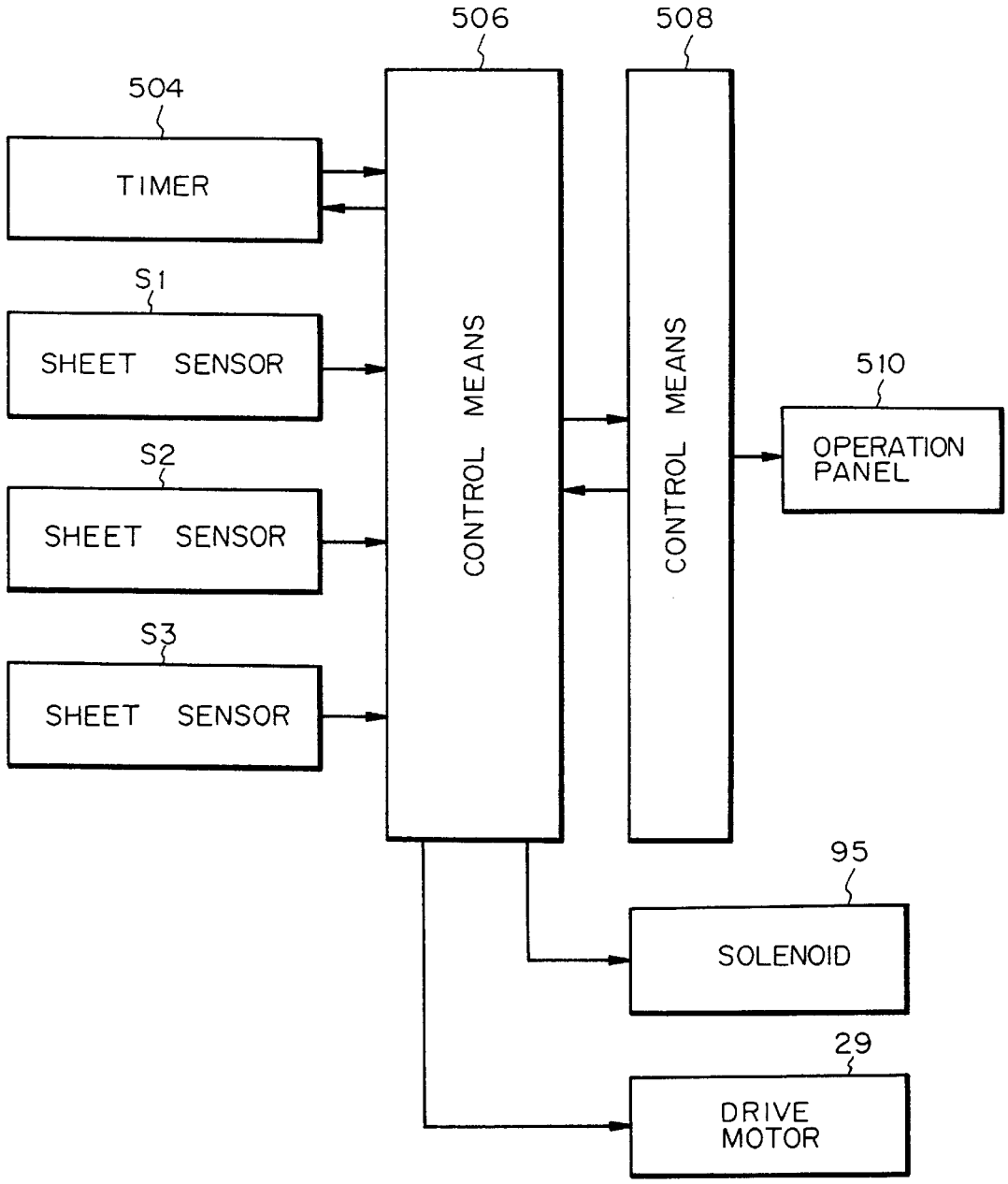
FIG. 23 is a block diagram schematically showing a control system included in the embodiment of FIG. 22.

Referring to FIGS. 22–25, a further alternative embodiment of the present invention is shown which is capable of accurately informing the operator of a location where a sheet jam has occurred. As shown in FIG. 22, second sheet sensors S3 and S2, as distinguished from the sheet sensor S1, are respectively positioned at the downstream portion of the first switching section 16 and the downstream portion of the horizontal transport section 17. As shown in FIG. 23, signals output from the sheet sensors S2 and S3 are sent to control means 506 similar to the control means 502 of the previous embodiment.

Figure 24:
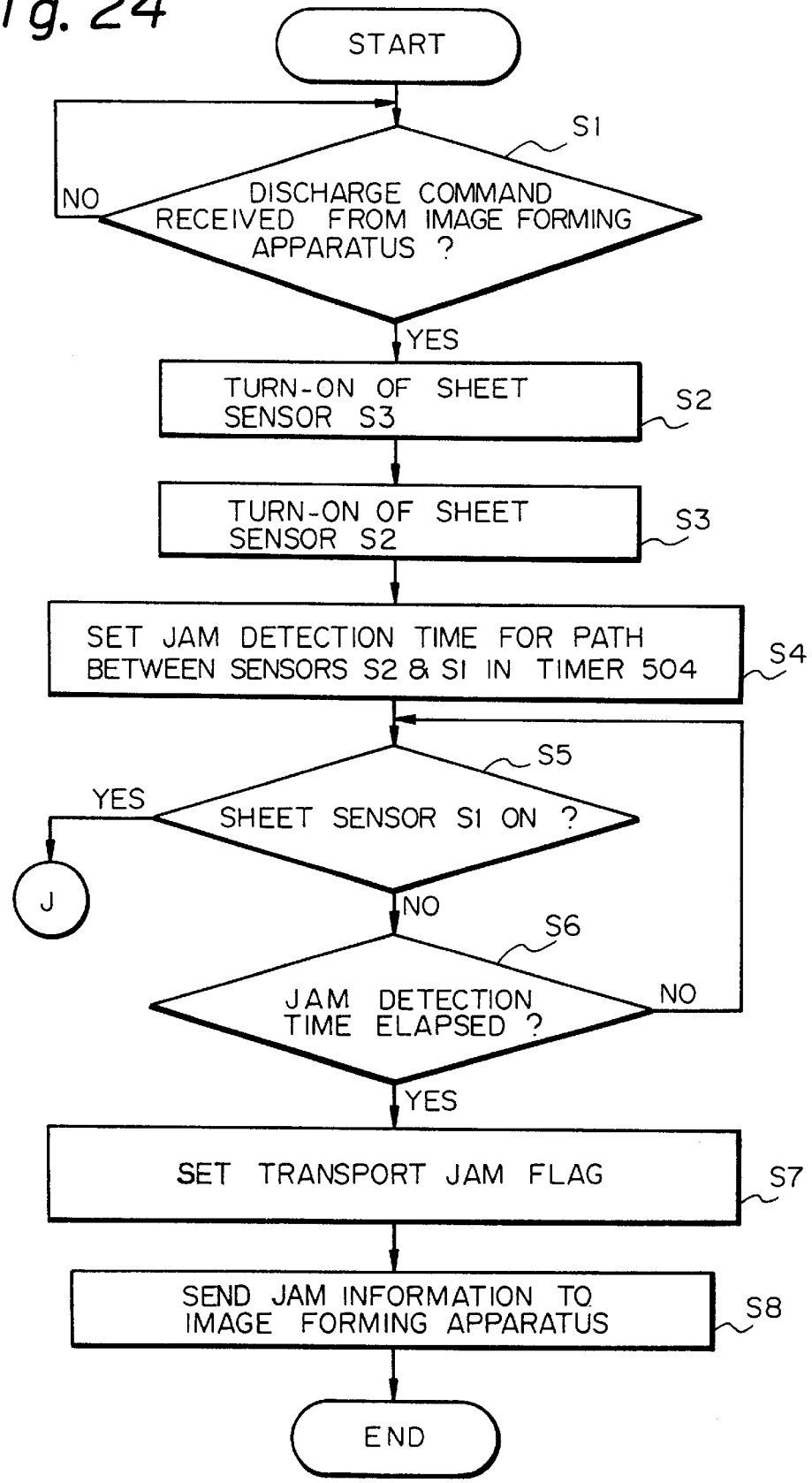
FIGS. 24 and 25 are flowcharts representative of a specific operation of the embodiment of FIG. 22.
Figure 25:
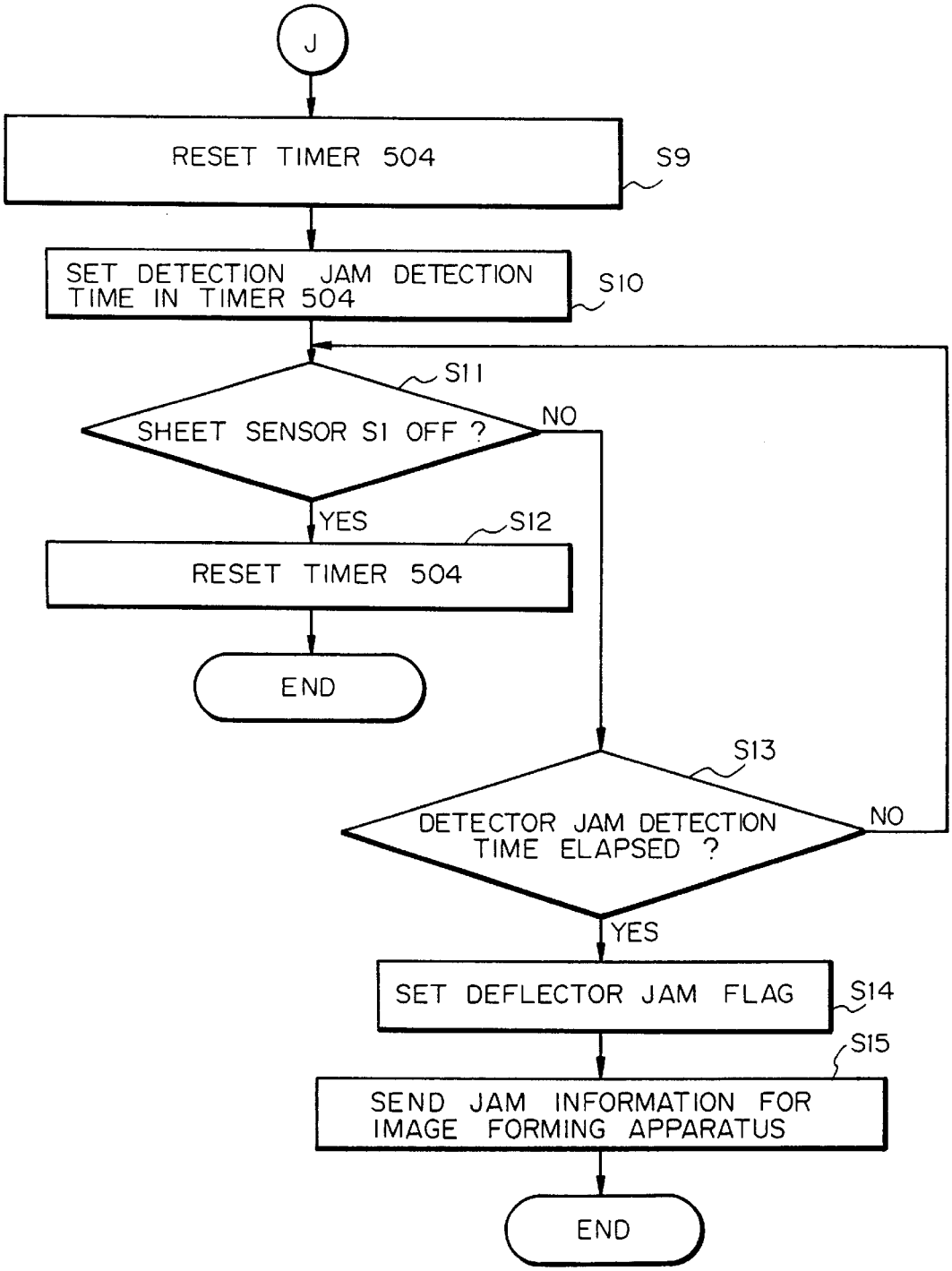

A specific operation of the illustrative embodiment will be described hereinafter. As shown in FIG. 24, the control means 506 determines whether or not a sheet discharge command has been received from the image forming apparatus (printer 2) (step S1). If the answer of the step S1 is YES, the control means 506 confirms the turn-on of the sheet sensor S3 (step S2) and the turn-on of the sheet sensor S2 (step S3), meaning that a sheet has been smoothly conveyed a long the horizontal transport line. After receiving an ON signal from the sheet sensor S2, the control means 506 sets a jam detection time assigned to the path between the sheet sensors S2 and S1 in the timer 504 and then starts the timer 504 (step S4). Subsequently, the control means 506 determines whether or not the sheet sensor S1 has turned on (step S5). If the answer of the step S5 is negative (NO), then the control means 506 determines whether or not the jam detection time has elapsed on the basis of the output signal of the timer 504 (step S6).

If the jam detection time has elapsed (YES, step S6), the control means 506 sets a jam flag meant for the path between the sensors S2 and S1 in the flag area of the RAM (step S7) and sends jam data to control means 508 (FIG. 23) included in the image forming apparatus (step S8). In response, the control means 508 interrupts the printing operation under way and displays a message informing the operator of the jam on an operation panel 510 mounted on the image forming apparatus. The message is of the kind allowing the operator to see that the jam has occurred between the sheet sensors S2 and S1 (transport jam).

When the sheet sensor S1 turns on (YES, step S5), the control means 506 resets the timer (step S9), sets a preselected period of time for detecting a jam ascribable to the deflector in the timer 504 (step S10), and then starts the timer 504. Subsequently, the control means 506 determines whether or not the sheet sensor S1 has turned off (step S11). If the answer of the step S11 is YES, meaning that the sheet has been successfully driven into the bin 6, the control means 506 resets the timer 504 (step S12). It is to be noted that a jam ascribable to the deflector refers to an occurrence that a sheet is caught by the deflector 35*a* and prevented from advancing thereby.

If the answer of the step S11 is NO, then the controller 506 determines whether or not the deflector jam detection time set in the timer 504 has elapsed (step S13). If the answer of the step S13, the control means 506 sets a deflector jam flag in the flag area of the RAM (step S14) and sends jam data to the control means 508 of the image forming apparatus (step S15). In response, the control means 508 interrupts the printing operation under way and displays a message informing the operator of the jam ascribable to the deflector 35*a* on the operation panel 510.

When two bin units are positioned one above the other in order to increase the total number of bins, as shown in FIG. 17 specifically, additional sheet sensors S4, S5 and S6 indicated by dash-and-dots lines may be located. In such a case, a jam will be located by taking account of the outputs of the additional sensors S4–S6 as well.

Figure 26:
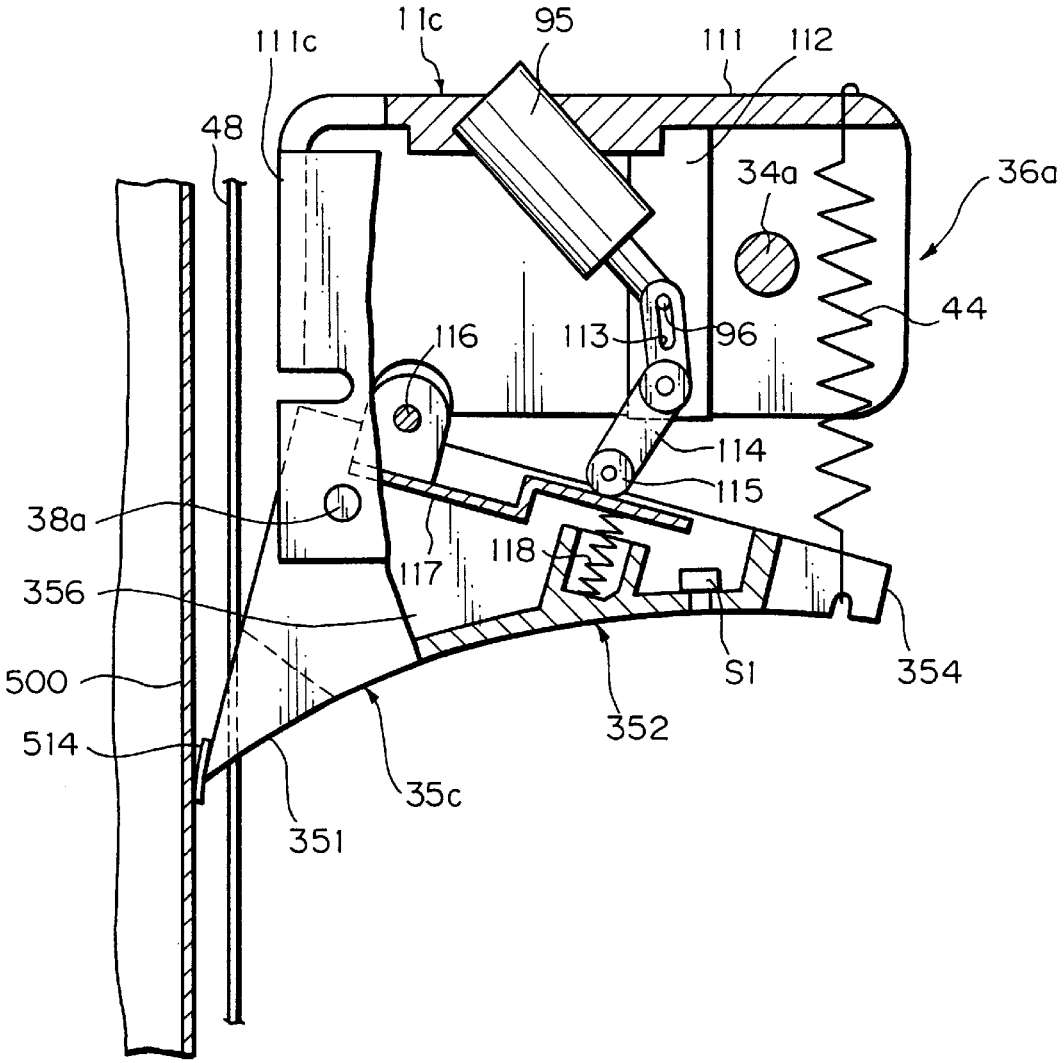
FIG. 26 is a section showing a modified form of sheet deflecting means included in the illustrative embodiments.
Figure 28:
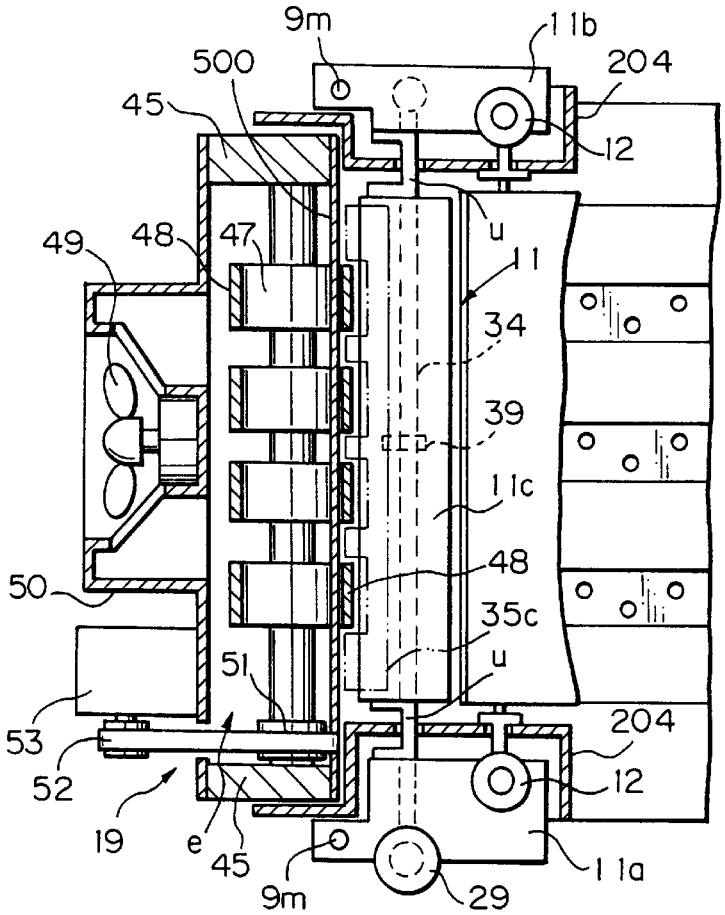
FIGS. 28 and 29 are respectively a plan view and a side elevation, showing the deflector shown in FIG. 27 together with endless belts.
Figure 29:
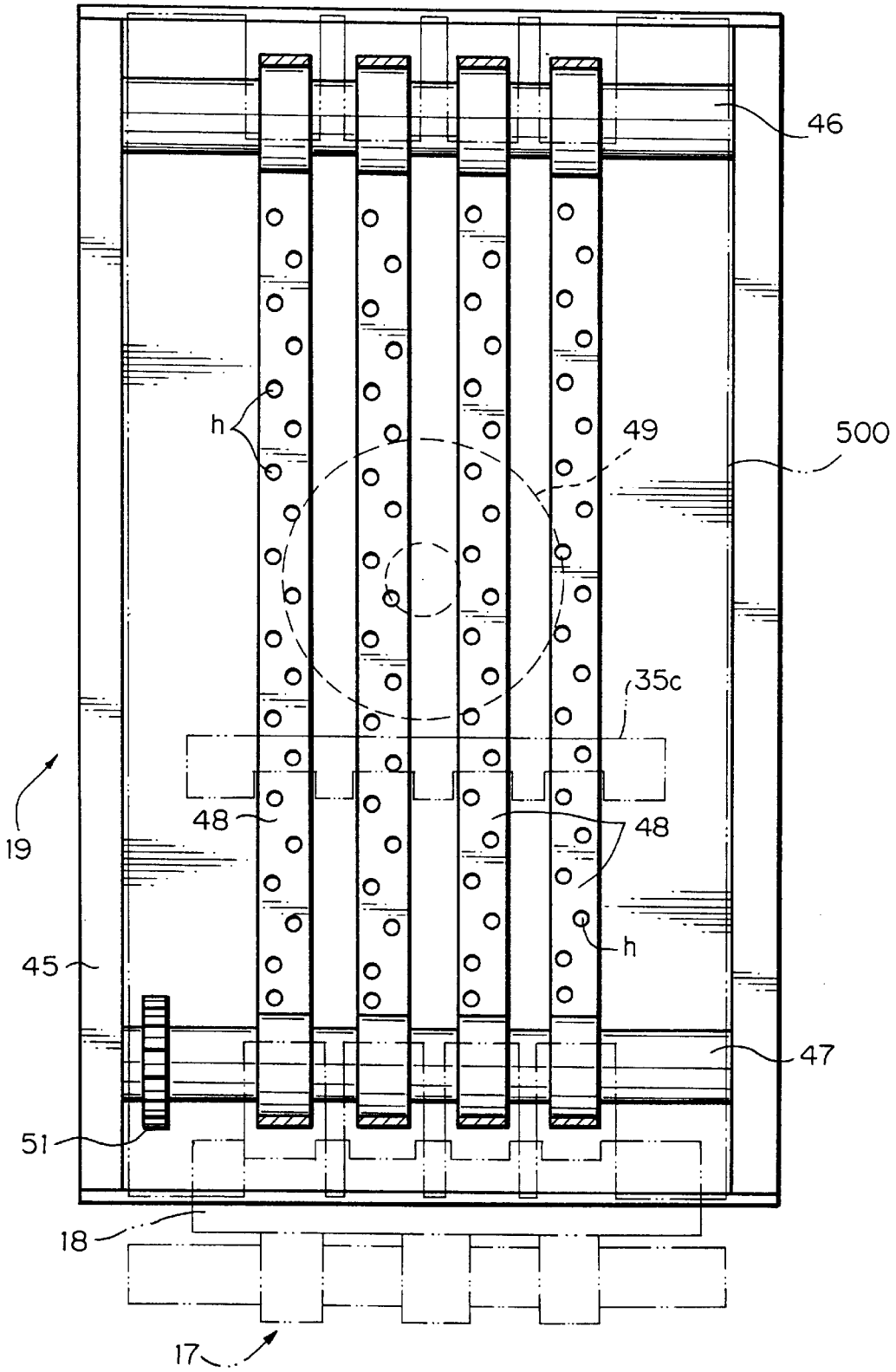

In the embodiments shown and described, the deflectors 35 and 35*a* each contact the surfaces of the endless belts 48 for scooping up the leading edge of a sheet. A modification of such a configuration is shown in FIG. 26. As shown, a deflector 35*c* is capable of moving into the space between opposite runs of the belts 48. FIGS. 28 and 29 show a positional relation between the deflector 35*c* and the belts 48.

Figure 27:
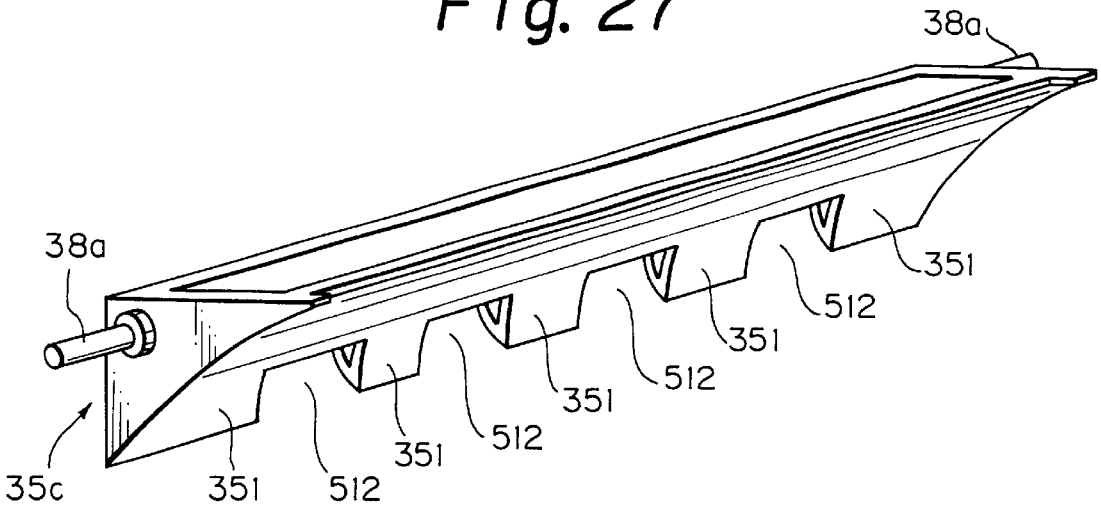
FIG. 27 is a perspective view showing a deflector included in the modification of FIG. 27.

Specifically, as shown in FIG. 27, the deflector 35*c* has an edge 351 formed with notches 512 each of which is capable of receiving one of the belts 48. The edge 351 is therefore implemented as a plurality of edge portions 351 capable of entering the spaces between the belts 48 when the deflector 35*c* is brought to its operative or deflecting position. The switching means 36*a* for switching the deflector 35*c* is not shown in FIG. 27. The deflector 35*c* having such a comb-like configuration and capable of protruding to the space between the opposite runs of the belts 48 is capable of surly scooping up a sheet. In addition, it is not necessary to highly accurately shape the edge 351 of the deflector 35*c*.

The guide plate 500 positioned at the back (inside) of the belts 48 should preferably be as close to the belts 48 as possible in a range in which they do not interfere with the belts 48. However, the deflector 35*c* frequently moves back and forth and is likely to contact the guide plate 500 and accelerate the deterioration of the guide 500.

To solve the above problem, as shown in FIG. 26, a Mylar sheet 514 is fitted on the back of each edge portion 351 to play the role of a shock absorbing member. The Mylar sheets 514 allow the edge portions 351 to softly contact the guide plate 500. This absorbs an impact that the spring 118 cannot fully absorb, and reduces noise ascribable to hitting contact.

Figure 30:
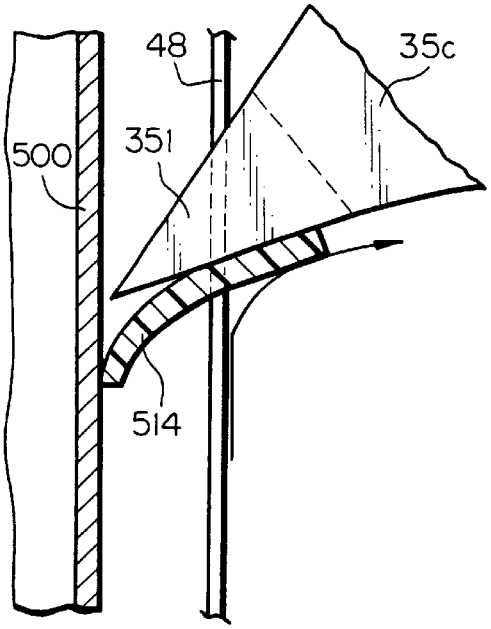
FIGS. 30 and 31 are front views each showing a particular modification of shock absorbing means.

As shown in FIG. 30, the Mylar sheets 512 can desirably guide a sheet even when fitted on the front surfaces of the edge portions 351 because they have smooth surfaces.

Figure 31:
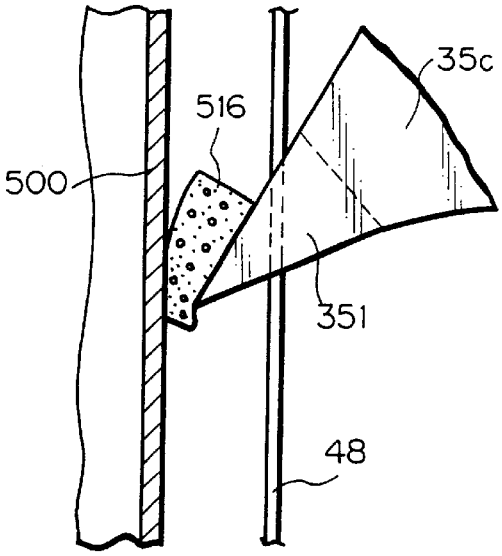
Figure 32:
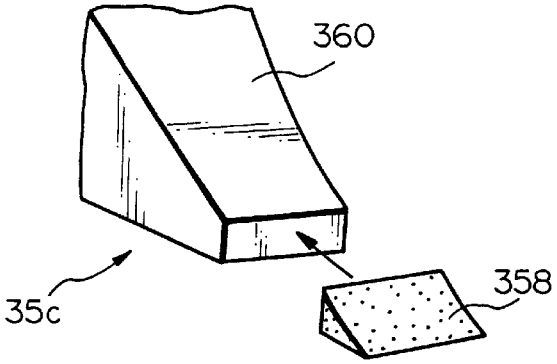
FIG. 32 is a perspective view showing another modification of the shock absorbing means.

As shown in FIG. 31, the Mylar sheets 514 may be replaced with pieces of sponge 516, if desired. Further, as shown in FIG. 32, a rubber piece 358 which is another specific form of the shock absorbing member may constitute the edge corresponding to the guide plate 500 and may be affixed to a deflector body 360.

While the illustrative embodiments have been shown and described as being connected to the stencil printer 2, they may be connected to any other kind of image forming apparatus having a sheet outlet, e.g., an electrophotographic copier.

In summary, it will be seen that the present invention provides a sheet storing apparatus having various unprecedented advantages, as enumerated below.

(1) When cams rotatably supported by an elevatable frame rotate while being subjected to a load in the up-and-down direction, one of a stack of bins is moved toward one adjoining bin away from the other adjoining bin. As a result, the cams are moved upward or downward along rails together with the frame. At the same time, sheet deflecting means mounted on the frame is raised or lowered. The frame therefore rises or falls along the rails while being subjected to the above load. This allows the cams to smoothly rotate without sliding in the up-and-down direction and to rapidly broaden the inlet of the bin contacting the bottoms of the cams, while enhancing the durability of the cams and bins. Further, the relative position between the sheet deflecting means mounted on the frame and the inlet of the bin contacting the bottoms of the cams remains substantially constant. Therefore, the sheet deflecting means steers a sheet toward the inlet away from a transport surface at a preselected angle at all times without regard to the direction of movement of the frame, i.e., upward or downward. The sheet can therefore be surely guided into the inlet.

(2) The sheet is conveyed to the inlet of the bin along a relatively long path including a position below the stack of bins and the transport surface adjoining the frame. In addition, an unfixed image printed on the sheet is prevented from contacting members constituting the path before reaching the bin. This promotes drying of the unfixed image during sheet transport and protects the image from blurring. This is particularly true with a printer with which the drying of an unfixed image is the prerequisite.

(3) Each bin is supported by respective locking pieces or support members independently of the other bins and can therefore be easily provided with positional accuracy. In addition, only the weight of sheets stacked on the bin acts on the locking pieces as a load, so that durability is enhanced and noise is reduced. Particularly, when a stapler is positioned at the opposite side to the inlets of the bins, there can be promoted easy stapling because of the positional accuracy of the bins in the up-and-down direction.

(4) A deflector and switching means for switching it are movable up and down together with the elevatable frame. When the switching means switches the deflector to an operative or deflecting position, the deflector steers a sheet to the inlet of a designated bin away from the transport surface, surely inserting the sheet into the inlet. When the switching means switches the deflector to an inoperative or retracted position, the deflector is released form sheet feeding means. This prevents the sheet feeding means and deflector from contacting each other and thereby enhances their durability.

(5) When the deflector is brought to the operative position, the resulting reaction of the transport surface is absorbed by the deformation of a stroke adjusting spring. This prevents the transport surface and deflector from excessively pressing each other and thereby enhances their durability.

(6) A single sensor mounted on the deflector is capable of determining whether or not the distribution of sheets to all the bins were successful. This makes it needless to assign an exclusive sheet sensor to each bin and thereby reduces the cost.

(7) A power source is mounted on the frame and can have its rotation transferred to the cams via a shaft and a plurality of gear trains. At this instant, the cams rotate surely and stably.

(8) A jam is detected on the basis of the output of a first sheet sensor and the outputs of second sheet sensors arranged on the path terminating at the deflector. A jam can therefore be accurately located. This frees the operator from wasteful work for jam location.

(9) The cams and deflector are independent of each other. Therefore, despite that both the cams and deflector are mounted on the frame, their relative position can be relatively freely set, promoting free layout and free configuration while simplifying the apparatus.

(10) The cams are rotated on the basis of information representative of the leading edge of a sheet. The cams can therefore start rotating at a timing matching with a sheet size, so that the apparatus can adapt to the high-speed operation of an image forming apparatus.

(11) The sheet sensor mounted on the deflector allows the cams to be simply and surely controlled.

(12) The cams are rotated on the basis of an optimal delay time matching with a sheet size. The cams can therefore start rotating a timing matching with a sheet size, so that the apparatus can adapt to the high-speed operation of an image forming apparatus.

(13) The cams are rotated on the basis of an optimal delay time matching with a sheet size and a bin number. This enhances accurate delay time control.

(14) A jam is sensed on the basis of the output signal of the sheet sensor mounted on the deflector and the output signals of sheet sensors arranged on a transport bath terminating at the deflector. This allows a jam to be surely located and saves the operator's work.

(15) When the sensor on the deflector continuously senses a sheet over a preselected period of time, it is determined that a jam has occurred at the deflector. This also allows a jam to be surely located and saves the operator's work.

(16) The deflector has a comb-like edge capable entering spaces between endless belts. In addition, shock absorbing members are fitted on the portions of the edge expected to contact a guide plate which is located at the back of the belts. It follows that the deflector can surely scoop up a sheet from the transport surface and is protected from damage ascribable to its contact with the guide plate. In addition, noise ascribable to hitting contact is reduced.

(17) When the edge portions of the deflector are constituted by shock absorbing members, the separate shock absorbing members are omissible.

(18) Sheet stacks are taken out in the widthwise direction of sheets perpendicular to the direction of sheet entry and therefore without being obstructed by a frame. This broadens a space available for the operator to take out sheet stacks and therefore facilitates easy operation.

Various modifications will become possible for those skilled in the art after receiving the teachings of the present disclosure without departing from the scope thereof.

What is claimed is:

1. An apparatus for storing sheets driven out of an image forming apparatus, comprising:

a frame connectable to the image forming apparatus;

a plurality of bins stacked on said frame;

sheet feeding means for feeding a sheet driven out of the image forming apparatus to a transport surface for deflection facing said plurality of bins;

a plurality of rails supported vertically by said frame and facing edges of said plurality of bins;

an elevatable frame slidably supported by said plurality of rails;

a plurality of cams affixed to cam shafts that are rotatably supported by said elevatable frame and each including a cylindrical main portion, said plurality of cams cooperating, every time said plurality of cams each makes a rotation sufficient to feed one of the two bins respectively contacting an upper end and a lower end of said main portion to the other end, to broaden an inlet of the bin contacting said lower end;

cam drive means for causing said plurality of cams to rotate; and sheet deflecting means mounted on said elevatable frame for steering the sheet that has reached said transport surface toward an inlet of a preselected bin and inserting said sheet into said inlet.

2. An apparatus as claimed in claim 1, wherein said elevatable frame is positioned at a side opposite to a side where the image forming apparatus is located, whereby the sheet driven out of said image forming apparatus is conveyed to said transport surface via a position beneath said plurality of bins.

3. An apparatus as claimed in claim 1, wherein said plurality of bins each have an end opposite to said inlet supported by respective locking pieces affixed to said frame.

4. An apparatus as claimed in claim 3, wherein said frame is positioned in front of said end opposite to said inlet in a direction of sheet entry, said locking pieces protruding toward said inlet.

5. An apparatus as claimed in claim 1, wherein said cam drive means comprises:

a plurality of gear trains respectively connected to said plurality of cams;

a shaft for interlocking said plurality of gear trains; and a drive source mounted on said elevatable frame for causing said plurality of cams to rotate in unison via said shaft and said plurality of gear trains.

6. An apparatus for storing sheets driven out of an image forming apparatus, comprising:

a frame connectable to the image forming apparatus;

a plurality of bins stacked on said frame;

sheet feeding means for feeding a sheet driven out of the image forming apparatus to a transport surface for deflection facing said plurality of bins;

a plurality of rails supported vertically by said frame and facing edges of said plurality of bins;

an elevatable frame slidably supported by said plurality of rails;

a plurality of cams rotatably supported by said elevatable frame and each including a cylindrical main portion, said plurality of cams cooperating, every time said plurality of cams each makes a rotation sufficient to feed one of the two bins respectively contacting an upper end and a lower end of said main portion to the other end, to broaden an inlet of the bin contacting said lower end;

cam drive means for causing said plurality of cams to rotate; and sheet deflecting means mounted on said elevatable frame for steering the sheet that has reached said transport surface toward an inlet of a preselected bin and inserting said sheet into said inlet, wherein said sheet deflecting means comprises a deflector pivotally connected to said elevatable frame and switching means for moving said deflector between an operative position where said deflector contacts said transport surface and an operative position where said deflector does not contact said transport surface.

7. An apparatus as claimed in claim 6, wherein said deflector receives a switching force of said switching means via a spring for stroke adjustment.

8. An apparatus as claimed in claim 7, wherein said switching means is mounted on a rotatable shaft on which said deflector is mounted.

9. An apparatus as claimed in claim 7, wherein said transport surface is formed by a plurality of endless belts spaced from each other in a widthwise direction of the sheet perpendicular to a direction of sheet transport, wherein a guide plate capable of guiding opposite edges of the sheet in said direction of sheet transport is positioned at a back of said transport surface, wherein said deflector has a comb-like configuration capable of entering spaces between said plurality of endless belts at a position for steering said sheet, and wherein shock absorbing members are fitted on said deflector for easing a contact of said deflector with said guide plate or preventing said deflector for contacting said guide plate when said deflector is brought to a deflecting position.

10. An apparatus as claimed in claim 9, wherein portions of said deflector expected to contact said guide plate are formed of said shock absorbing members.

11. An apparatus as claimed in claim 6, further comprising a first sheet sensor mounted on said deflector for sensing the sheet being steered toward the inlet of the bin away from said transport surface by said deflector.

12. An apparatus as claimed in claim 11, wherein said switching means is mounted on a rotatable shaft on which said deflector is mounted.

13. An apparatus as claimed in claim 11, further comprising control means for determining, based on information representative of a leading edge of the sheet and output of said first sheet sensor, a timing for causing said cams to start rotating.

14. An apparatus as claimed in claim 13, wherein said control means selects an optimal delay time, which is a time interval between a detection of the leading edge of the sheet and a start of rotation of said cams, for each sheet size on the basis of sheet size information.

15. An apparatus as claimed in claim 13, wherein said control means selects an optimal delay time, which is a time interval between a detection of the leading edge of the sheet and a start of rotation of said cams, for each sheet size on the basis of sheet size information and information representative of a number assigned to the bin.

16. An apparatus as claimed in claim 11, further comprising at least one second sheet sensor positioned on a sheet transport path terminating at said first sheet sensor, and control means for locating a jam on the basis of information output from said first sheet sensor and said second sheet sensor and sending jam information when located a jam.

17. An apparatus as claimed in claim 16, wherein said control means determines, when said first sheet sensor continuously senses the sheet over a preselected period of time, that a jam has occurred at said deflector, and sends the jam information.

18. An apparatus as claimed in claim 6, wherein said switching means comprises springs constantly biasing said deflector toward said inoperative position, and a deflector cam driven by said cam drive means for moving said deflector from said inoperative position to said operative position.

19. An apparatus as claimed in claim 18, wherein said switching means is mounted on a rotatable shaft on which said deflector is mounted.

20. An apparatus as claimed in claim 6, wherein said transport surface is formed by a plurality of endless belts spaced from each other in a widthwise direction of the sheet perpendicular to a direction of sheet transport, wherein a guide plate capable of guiding opposite edges of the sheet in said direction of sheet transport is positioned at a back of said transport surface, wherein said deflector has a comb-like configuration capable of entering spaces between said plurality of endless belts at a position for steering said sheet, and wherein shock absorbing members are fitted on said deflector for easing a contact of said deflector with said guide plate or preventing said deflector from contacting said guide plate when said deflector is brought to a deflecting position.

21. An apparatus as claimed in claim 20, wherein portions of said deflector expected to face said guide plate are formed of said shock absorbing members.

22. An apparatus as claimed in claim 6, wherein said switching means is mounted on a rotatable shaft on which said deflector is mounted.

* * * * *